US008739557B2

(12) United States Patent
Metzger

(10) Patent No.: US 8,739,557 B2
(45) **Date of Patent: *Jun. 3, 2014**

(54) SYSTEM AND METHOD FOR DISTRIBUTING AND STACKING BAGS OF ICE

(75) Inventor: Mark C. Metzger, Glendale, AZ (US)

(73) Assignee: Reddy Ice Corporation, Dallas, TX (US)

( * ) Notice: Subject to any disclaimer, the term of this patent is extended or adjusted under 35 U.S.C. 154(b) by 321 days.

This patent is subject to a terminal disclaimer.

(21) Appl. No.: 12/914,681

(22) Filed: Oct. 28, 2010

(65) Prior Publication Data

US 2011/0185749 A1 Aug. 4, 2011

Related U.S. Application Data

(60) Provisional application No. 61/300,612, filed on Feb. 2, 2010.

(51) Int. Cl.

| | |
|---|---|
| ***B65B 63/08*** | (2006.01) |
| ***F25C 5/18*** | (2006.01) |
| ***B65G 59/00*** | (2006.01) |

(52) U.S. Cl.

USPC ..... 62/60; 62/644; 221/175

(58) Field of Classification Search

USPC ..... 62/60, 344; 53/540, 469; 221/175, 177

See application file for complete search history.

(56) References Cited

U.S. PATENT DOCUMENTS

| | | | |
|---|---|---|---|
| 2,116,300 | A | 5/1938 | Campos |
| 2,584,726 | A | 2/1952 | McOmber |
| 3,559,424 | A | 2/1971 | Nelson |
| 3,712,019 | A | 1/1973 | Lamka et al. |
| 3,789,570 | A | 2/1974 | Mullins, Jr. |
| 3,807,193 | A | 4/1974 | McKenney et al. |
| 3,897,676 | A | 8/1975 | Membrino |
| 3,913,343 | A | 10/1975 | Rowland et al. |
| 3,918,266 | A | 11/1975 | Gindy et al. |
| 3,969,909 | A | 7/1976 | Barto et al. |
| 3,977,851 | A | 8/1976 | Toya |
| 3,982,377 | A | 9/1976 | Vanderpool |
| 4,013,199 | A | 3/1977 | Brown |
| 4,132,049 | A | 1/1979 | Mullins, Jr. |
| 4,139,029 | A | 2/1979 | Geraci |
| 4,348,872 | A | 9/1982 | Hill |
| 4,350,004 | A | 9/1982 | Tsujimoto et al. |
| 4,368,608 | A | 1/1983 | Ray |

(Continued)

FOREIGN PATENT DOCUMENTS

| | | |
|---|---|---|
| GB | 1459629 | 12/1976 |
| JP | 2006-105559 | 4/2006 |
| WO | WO 2004042294 | 5/2004 |
| WO | WO 2008089762 | 7/2008 |

OTHER PUBLICATIONS

U.S. Appl. No. 12/130,946, May 30, 2008, Metzger.
U.S. Appl. No. 60/941,191, May 31, 2007, Metzger.

(Continued)

*Primary Examiner* — Judy Swann
*Assistant Examiner* — Christopher R Zerphey
(74) *Attorney, Agent, or Firm* — Haynes and Boone, LLP

(57) ABSTRACT

A system and method according to which ice is automatically disposed in respective bags and the bags of ice are distributed and stacked within a temperature-controlled storage unit, such as an ice merchandiser.

2 Claims, 19 Drawing Sheets

(56) References Cited

U.S. PATENT DOCUMENTS

| | | | | |
|---|---|---|---|---|
| 4,404,817 | A | 9/1983 | Cox, III | |
| 4,409,763 | A | 10/1983 | Rydeen | |
| 4,420,197 | A | 12/1983 | Dreiling | |
| 4,461,520 | A | 7/1984 | Alneng | |
| 4,612,779 | A | 9/1986 | Hatton | |
| 4,689,937 | A | 9/1987 | Finan, Sr. et al. | |
| 5,027,610 | A | 7/1991 | Hara | |
| 5,088,300 | A | 2/1992 | Wess | |
| 5,109,651 | A | 5/1992 | Stuart | |
| 5,211,030 | A | 5/1993 | Jameson | |
| 5,277,016 | A * | 1/1994 | Williams et al. | 53/459 |
| 5,440,863 | A | 8/1995 | Toya et al. | |
| 5,458,851 | A | 10/1995 | Schroeder et al. | |
| 5,473,865 | A | 12/1995 | Tanaka et al. | |
| 5,484,209 | A | 1/1996 | Weng | |
| 5,489,769 | A | 2/1996 | Kubo | |
| 5,555,743 | A | 9/1996 | Hatanaka | |
| 5,577,821 | A | 11/1996 | Chu | |
| 5,581,982 | A | 12/1996 | Schroeder et al. | |
| 5,630,310 | A | 5/1997 | Chadwell | |
| D379,880 | S | 6/1997 | Stoeckli et al. | |
| 5,708,223 | A | 1/1998 | Wyss | |
| 5,722,750 | A | 3/1998 | Chu | |
| 5,761,888 | A | 6/1998 | Haley | |
| 5,813,196 | A | 9/1998 | Page et al. | |
| 5,822,955 | A | 10/1998 | Woosley et al. | |
| D407,092 | S | 3/1999 | Weaver | |
| 5,887,758 | A | 3/1999 | Hawkes et al. | |
| 6,044,658 | A | 4/2000 | Ryu | |
| 6,067,658 | A | 5/2000 | Cho | |
| 6,067,806 | A | 5/2000 | Park | |
| 6,082,350 | A | 7/2000 | Crews et al. | |
| 6,112,539 | A | 9/2000 | Colberg | |
| 6,112,558 | A | 9/2000 | Wang | |
| 6,119,441 | A | 9/2000 | Lipes et al. | |
| 6,134,907 | A | 10/2000 | Mueller et al. | |
| 6,238,031 | B1 | 5/2001 | Weng | |
| 6,266,945 | B1 | 7/2001 | Schroeder | |
| 6,338,002 | B1 | 1/2002 | Kuo | |
| 6,354,338 | B1 | 3/2002 | Takemoto | |
| 6,377,863 | B1 | 4/2002 | Koontz et al. | |
| 6,405,553 | B1 | 6/2002 | Willett | |
| 6,427,456 | B2 | 8/2002 | Niwa et al. | |
| 6,474,048 | B1 | 11/2002 | Metzger et al. | |
| 6,474,049 | B1 | 11/2002 | Lipes et al. | |
| 6,502,416 | B2 | 1/2003 | Kawasumi et al. | |
| 6,506,428 | B1 | 1/2003 | Berge et al. | |
| 6,606,602 | B1 | 8/2003 | Kolls | |
| 6,705,107 | B2 | 3/2004 | Schlosser et al. | |
| 6,827,529 | B1 | 12/2004 | Berge et al. | |
| 6,850,996 | B2 | 2/2005 | Wagner | |
| 6,860,111 | B2 | 3/2005 | Sanuki et al. | |
| 6,904,946 | B2 | 6/2005 | James | |
| 6,932,124 | B2 | 8/2005 | Dalton et al. | |
| 6,938,428 | B2 | 9/2005 | Onishi et al. | |
| 6,953,132 | B2 | 10/2005 | McCann et al. | |
| 7,003,974 | B1 | 2/2006 | Brooks | |
| 7,013,657 | B2 | 3/2006 | Hwang et al. | |
| 7,062,892 | B2 | 6/2006 | Metzger | |
| 7,096,686 | B2 | 8/2006 | Brunner et al. | |
| 7,104,291 | B2 | 9/2006 | Dalton et al. | |
| 7,207,156 | B2 | 4/2007 | Metzger | |
| 7,426,812 | B2 | 9/2008 | Metzger | |
| 2004/0084106 | A1 | 5/2004 | James | |
| 2004/0216481 | A1 | 11/2004 | James et al. | |
| 2006/0005553 | A1 | 1/2006 | Metzger | |
| 2006/0005564 | A1 | 1/2006 | Metzger | |
| 2007/0175235 | A1 | 8/2007 | Metzger | |
| 2007/0209330 | A1 | 9/2007 | Metzger | |
| 2008/0022635 | A1 | 1/2008 | Metzger | |
| 2008/0047233 | A1 | 2/2008 | Metzger | |
| 2008/0110129 | A1 | 5/2008 | LeBlanc et al. | |
| 2008/0142398 | A1 * | 6/2008 | Carrigan et al. | 206/499 |
| 2008/0295462 | A1 * | 12/2008 | Metzger | 53/469 |
| 2010/0011710 | A1 | 1/2010 | Pape | |
| 2010/0024363 | A1 | 2/2010 | Pape | |
| 2010/0268375 | A1 | 10/2010 | Pape | |
| 2010/0313524 | A1 | 12/2010 | Pape et al. | |
| 2011/0041467 | A1 | 2/2011 | Pape | |

OTHER PUBLICATIONS

U.S. Appl. No. 60/837,374, Aug. 11, 2006, Metzger.

U.S. Appl. No. 12/356,410, Jan. 20, 2009, Metzger.

Louis K. Huynh, Notice of Allowance and Fee(s) Due regarding U.S. Appl. No. 11/371,300, Aug. 4, 2008; 6 pages; U.S. Patent and Trademark Office.

Louis K. Huynh, Notice of Allowance and Fee(s) Due regarding U.S. Appl. No. 11/371,300, Apr. 21, 2008; 9 pages; U.S. Patent and Trademark Office.

Louis K. Huynh, Office Action issued on Mar. 26, 2007, in U.S. Appl. No. 11/371,300, U.S. Patent and Trademark Office.

Information Disclosure Statement filed Mar. 13, 2007 by Applicant, Mark Metzger, in U.S. Appl. No. 11/371,300.

Louis K. Huynh, Office Action/Restriction Requirement issued Feb. 12, 2007 in U.S. Appl. No. 11/371,300, U.S. Patent and Trademark Office.

J. Casimer Jacyna, Final Office Action issued on Jul. 18, 2007, in U.S. Appl. No. 10/701,984, U.S. Patent Office.

Derek L. Woods, "Decision on Petition" issued Apr. 20, 2007, in U.S. Appl. No. 10/701,984, Office of Petitions, U.S. Patent Office.

Derek L. Woods, "Decision on Petition" issued Nov. 8, 2006, in U.S. Appl. No. 10/701,984 Office of Petitions, U.S. Patent Office.

J. Casimer Jacyna, "Notice of Abandonment" issued Mar. 7, 2005, in U.S. Appl. No. 10/701,984, U.S. Patent Office.

J. Casimer Jacyna, "Office Action" issued Jul. 12, 2004 in U.S. Appl. No. 10/701,984, U.S. Patent Office.

Louis K. Huynh, "Notice of Allowance," mailed Oct. 17, 2008, in U.S. Appl. No. 11/931,324, U.S. Patent Office.

Louis K. Huynh, "Notice of Allowance," mailed Jun. 27, 2008, in U.S. Appl. No. 11/931,324, U.S. Patent Office.

Louis K. Huynh, "Office Action/Restriction Requirement," mailed Apr. 21, 2008, in U.S. Appl. No. 11/931,324, U.S. Patent Office.

International Search Report issued by the ISA/US, mailed Apr. 15, 2011, in connection with International App. No. PCT/US2011/023122.

Written Opinion issued by the ISA/US, mailed Apr. 15, 2011, in connection with International App. No. PCT/US2011/023122.

* cited by examiner

SYSTEM AND METHOD FOR DISTRIBUTING AND STACKING BAGS OF ICE

CROSS REFERENCE TO RELATED APPLICATIONS

This application claims the benefit of the filing date of U.S. patent application No. 61/300,612, filed Feb. 2, 2010, the entire disclosure of which is incorporated herein by reference.

This application is related to (1) U.S. patent application Ser. No. 10/701,984, filed Nov. 6, 2003; (2) U.S. patent application No. 60/647,221, filed Jan. 26, 2005; (3) U.S. patent application No. 60/659,600, filed Mar. 7, 2005; (4) U.S. patent application Ser. No. 11/371,300, filed Mar. 9, 2006, now U.S. Pat. No. 7,426,812; (5) U.S. patent application No. 60/837,374, filed Aug. 11, 2006; (6) U.S. patent application No. 60/941,191, filed May 31, 2007; (7) U.S. patent application Ser. No. 11/837,320, filed Aug. 10, 2007; (8) U.S. patent application Ser. No. 11/931,324, filed Oct. 31, 2007, now U.S. Pat. No. 7,497,062; (9) U.S. patent application Ser. No. 12/130,946, filed May 30, 2008; (10) U.S. patent application Ser. No. 12/356,410, filed Jan. 20, 2009, now U.S. Pat. No. 7,810,301; (11) U.S. patent application No. 61/300,612, filed Feb. 2, 2010; (12) U.S. patent application Ser. No. 12/856,451, filed Aug. 13, 2010; (13) International application no. PCT/US10/45648, filed Aug. 16, 2010; and (14) U.S. patent application Ser. No. 12/876,748, filed Sep. 7, 2010, the entire disclosures of which are incorporated herein by reference.

BACKGROUND

The present disclosure relates in general to ice and in particular to a system and method for distributing and stacking bags of ice within a temperature-controlled storage unit, such as a freezer or ice merchandiser.

DETAILED DESCRIPTION

Figure 1:
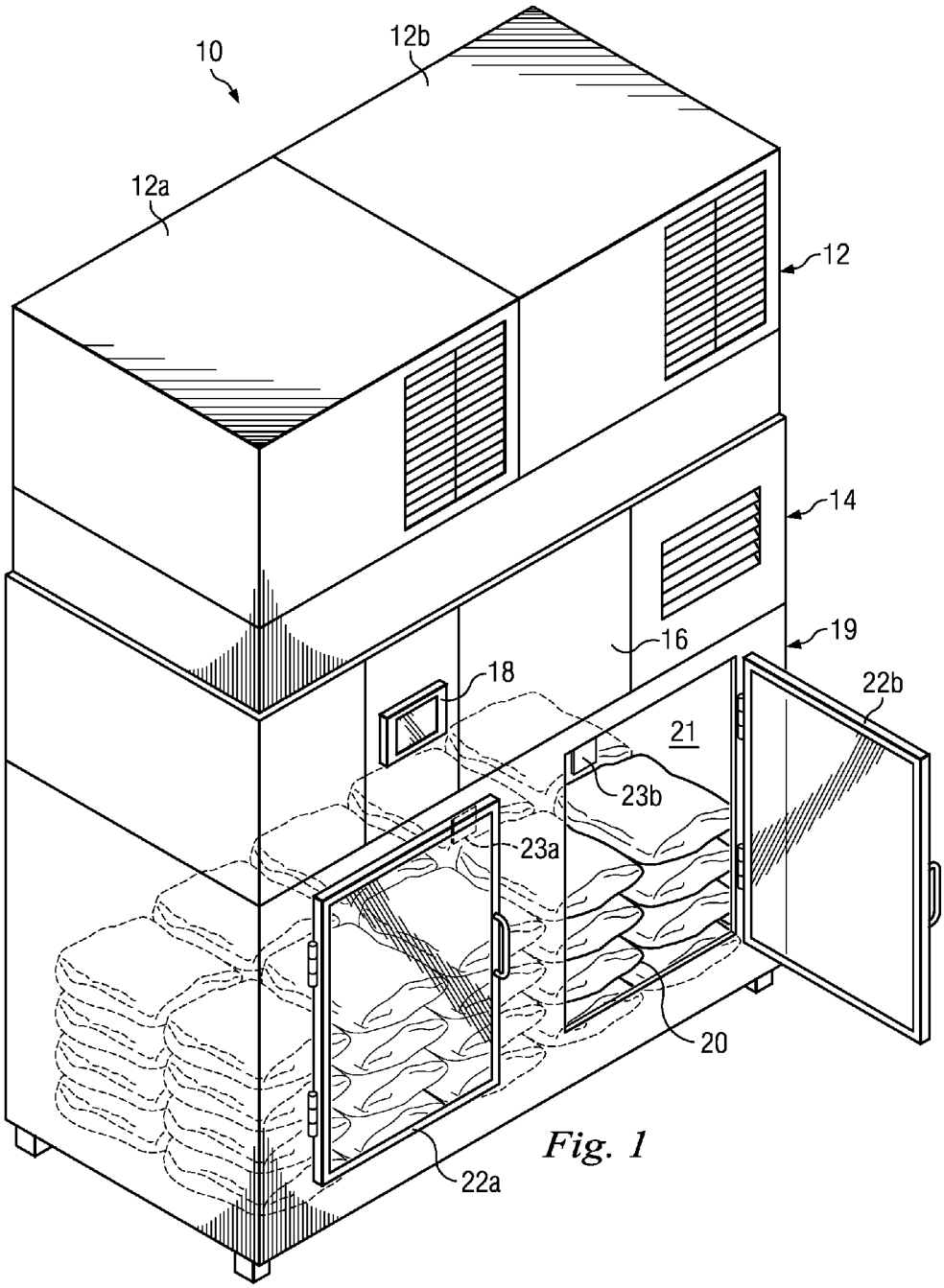
FIG. 1 is a perspective view of an ice bagging apparatus, according to an exemplary embodiment.

In an exemplary embodiment, as illustrated in FIG. 1, an ice bagging apparatus is generally referred to by the reference numeral 10 and includes ice makers 12*a* and 12*b*, which are positioned above an enclosure 14 having a panel 16. A control panel 18 is coupled to the enclosure 14. A temperature-controlled storage unit, such as a freezer or ice merchandiser 19, is positioned below, and coupled to, the enclosure 14, and is adapted to store ice-filled bags 20 in a temperature-controlled internal region 21 defined by the merchandiser 19, under conditions to be described below. The merchandiser 19 includes doors 22*a* and 22*b*, each of which is movable between open and closed positions. When the door 22*a* or 22*b* is in an open position, the door 22*a* or 22*b* permits access to the ice-filled bags 20 that are stored in the merchandiser 19. The door 22*a* is shown in its closed position in FIG. 1, and the door 22*b* is shown in an exemplary open position in FIG. 1. In several exemplary embodiments, the merchandiser 19 is, includes, or is part of, any type of freezer or other type of temperature-controlled storage unit. Sensors 23*a* and 23*b* are positioned in the door frames which cooperate with the doors 22*a* and 22*b*, respectively. In an exemplary embodiment, each of the ice makers 12*a* and 12*b* is a stackable ice cuber available from Hoshizaki America, Inc. In several exemplary embodiments, the ice bagging apparatus 10 is an in-store automated ice bagging apparatus, which is installed at a retail or other desired location, and is configured to automatically manufacture ice, automatically bag the manufactured ice (i.e., package the manufactured ice in bags), and store the bagged (or packaged) ice at the installation location.

Figure 2:
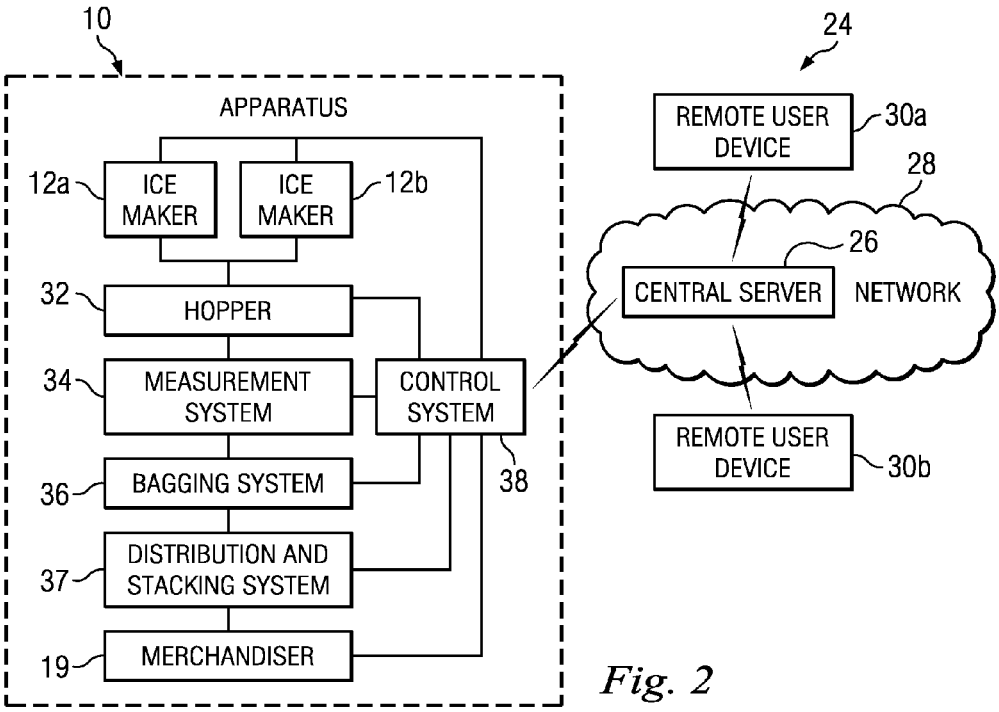
FIG. 2 is a diagrammatic illustration of a system according to an exemplary embodiment, the system including the ice bagging apparatus of FIG. 1, a central sever and a plurality of remote user devices, the ice bagging apparatus of FIG. 1 including ice makers, a hopper, a measurement system, a bagging system, a distribution and stacking system, a merchandiser, and an automatic control system.

In an exemplary embodiment, as illustrated in FIG. 2 with continuing reference to FIG. 1, a system is generally referred to by the reference numeral 24 and includes the ice bagging apparatus 10 and a central server 26, which is operably coupled to the ice bagging apparatus 10 via a network 28. Remote user devices 30*a* and 30*b* are operably coupled to, and are adapted to be in communication with, the central server 26 via the network 28. The remote user devices 30*a* and 30*b* are positioned at respective locations that are remote from the apparatus 10. In several exemplary embodiments, the network 28 includes the Internet, any type of local area network, any type of wide area network, any type of wireless network and/or any combination thereof. In several exemplary embodiments, each of the remote user devices 30*a* and 30*b* includes a personal computer, a personal digital assistant, a cellular telephone, a smartphone, other types of computing devices and/or any combination thereof. In several exemplary embodiments, the central server 26 includes a processor and a computer readable medium or memory operably coupled thereto for storing instructions accessible to, and executable by, the processor.

As shown in FIG. 2, the ice bagging apparatus 10 further includes a hopper 32, which is operably coupled to each of the ice makers 12*a* and 12*b*. A measurement system 34 is operably coupled to the hopper 32, and a bagging system 36 is operably coupled to the measurement system 34. A distribution and stacking system 37 is operably coupled to the bagging system 36. The merchandiser 19 is operably coupled to the distribution and stacking system 37. An automatic control system 38 is operably coupled to the ice makers 12*a* and 12*b*, the hopper 32, the measurement system 34, the bagging system 36, the distribution and stacking system 37, and the merchandiser 19.

In an exemplary embodiment, the ice makers 12*a* and 12*b* automatically make ice, and the ice is disposed in the hopper 32. The measurement system 34 is configured to automatically receive ice from the hopper 32, and automatically deliver measured amounts of ice to the bagging system 36. In an exemplary embodiment, the measurement system 34 includes a scale, which measures an amount of ice by weight. In an exemplary embodiment, the measurement system 34 defines a volume into which an amount of ice is received from the hopper 32, thereby volumetrically measuring the amount of ice. The measurement system 34 then delivers the volumetrically measured amount of ice to the bagging system 36. In an exemplary embodiment, the measurement system 34 is, or at least includes in whole or in part, one or more of the embodiments of measurement systems disclosed in U.S. patent application Ser. No. 10/701,984, filed Nov. 6, 2003, the entire disclosure of which is incorporated herein by reference. In an exemplary embodiment, the measurement system 34 is, or at least includes in whole or in part, one or more of the embodiments of measurement systems disclosed in U.S. patent application Ser. No. 11/371,300, filed Mar. 9, 2006, now U.S. Pat. No. 7,426,812, the entire disclosure of which is incorporated herein by reference, such as, for example, the drawer section disclosed in U.S. patent application Ser. No. 11/371,300. In an exemplary embodiment, the measurement system 34 is, or at least includes in whole or in part, one or more of the embodiments of measurement systems disclosed in U.S. patent application Ser. No. 11/837,320, filed Aug. 10, 2007, the entire disclosure of which is incorporated herein by reference, such as, for example, the compartment assembly disclosed in U.S. patent application Ser. No. 11/837,320. In an exemplary embodiment, the measurement system 34 is, or at least includes in whole or in part, one or more of the embodiments of measurement systems disclosed in the following U.S. patent applications: U.S. patent application No. 60/659,600, filed Mar. 7, 2005; U.S. patent application No. 60/837,374, filed Aug. 11, 2006; U.S. patent application No. 60/941,191, filed May 31, 2007; and U.S. patent application Ser. No. 11/931,324, filed Oct. 31, 2007, now U.S. Pat. No. 7,497,062, the entire disclosures of which are incorporated herein by reference.

In an exemplary embodiment, the bagging system 36 is configured to automatically provide bags so that the bags receive the respective measured amounts of ice from the measurement system 34. After a bag is filled with a desired amount of ice, the bagging system 36 is configured to automatically seal the bag and separate the bag from the remaining bags. In an exemplary embodiment, the bagging system 36 is, or at least includes in whole or in part, one or more of the embodiments of bagging mechanisms or systems disclosed in the following U.S. patent applications: U.S. patent application Ser. No. 11/931,324, filed Oct. 31, 2007, now U.S. Pat. No. 7,497,062; U.S. patent application Ser. No. 11/837,320, filed Aug. 10, 2007; and U.S. patent application Ser. No. 12/856,451, filed Aug. 13, 2010, the entire disclosures of which are incorporated herein by reference.

Figure 3:
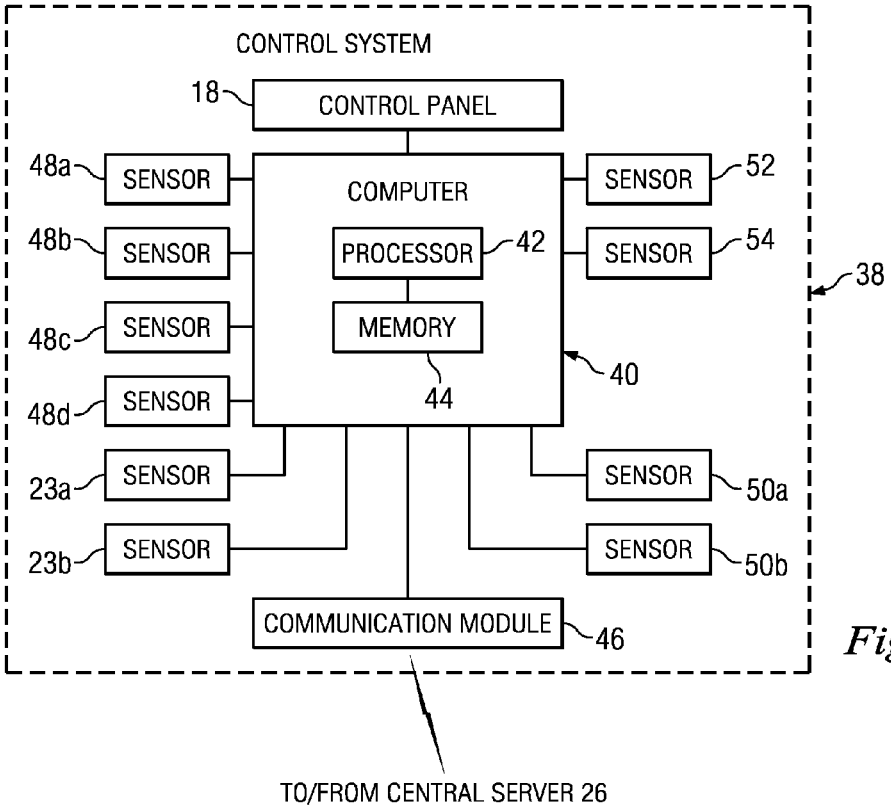
FIG. 3 is a diagrammatic illustration of the control system of FIG. 2, according to an exemplary embodiment.

In an exemplary embodiment, as illustrated in FIG. 3 with continuing reference to FIGS. 1 and 2, the automatic control system 38 includes a computer 40 including a processor 42 and a computer readable medium or memory 44 operably coupled thereto. In an exemplary embodiment, instructions accessible to, and executable by, the processor 42 are stored in the memory 44. In an exemplary embodiment, the memory 44 includes one or more databases and/or one or more data structures stored therein. A communication module 46 is operably coupled to the computer 40, and is adapted to be in two-way communication with the central server 26 via the network 28. The control panel 18 is operably coupled to the computer 40.

Sensors 48*a*, 48*b*, 48*c* and 48*d* are operably coupled to the computer 40. In an exemplary embodiment, each of the sensors 48*a*, 48*b*, 48*c* and 48*d* includes one or more sensors. In an exemplary embodiment, one or more of the sensors 48*a*, 48*b*, 48*c*, and 48*d* include respective photo cells. In an exemplary embodiment, the sensors 48*a*, 48*b*, 48*c* and 48*d* are distributed throughout the apparatus 10. In several exemplary embodiments, the sensors 48*a*, 48*b*, 48*c* and 48*d* are positioned in one or more different locations in one or more of the ice makers 12*a* and 12*b*, the hopper 32, the measurement system 34, the bagging system 36, the distribution and stacking system 37, the merchandiser 19, and the control system 38. In an exemplary embodiment, the sensor 48*a* is coupled to the hopper 32 and is used to measure the amount of ice in the hopper 32. In an exemplary embodiment, the sensor 48*b* is part of the bagging system 36 and is used to detect the presence of a bag that will be fed, is being fed, or that has been fed so that the bag is positioned to permit a measured amount of ice to be disposed therein. The sensor 48*c* will be described in further detail below. In an exemplary embodiment, the sensor 48*d* is used to control at least in part the sealing and separation of the ice-filled bags.

The sensors 23*a* and 23*b* are operably coupled to the computer 40. In an exemplary embodiment, the sensor 23*a* is, or includes, a coded interlock door switch configured to determine if the door 22*a* is open or closed, and the sensor 23*a* is operably coupled to a safety shut-off switch and the power control for the control system 38. Likewise, the sensor 23*b* is, or includes, a coded interlock door switch configured to determine if the door 22*b* is open or closed, and the sensor 23*b* is operably coupled to a safety shut-off switch and the power control for the control system 38. In an exemplary embodiment, each of the respective coded interlock door switches of the sensors 23*a* and 23*b* are configured to stop the supply of electrical power to at least the distribution and stacking system 37 of the system 24, under conditions to be described below.

Stacking level sensors 50*a* and 50*b* are operably coupled to the computer 40, and will be described in further detail below. Home position sensor 52 and home rotate sensor 54 are operably coupled to the computer 40, and will be described in further detail below.

In several exemplary embodiments, the computer 40 includes, and/or functions as, a data acquisition unit that is adapted to convert, condition and/or process signals transmitted by one or more of the sensors 23*a*, 23*b*, 48*a*, 48*b*, 48*c*, 48*d*, 50*a*, 50*b*, 52 and 54, and one or more other sensors operably coupled to the computer 40. In an exemplary embodiment, the control panel 18 is a touch screen, a multi-touch screen, and/or any combination thereof. In several exemplary embodiments, the control panel 18 includes one or more input devices such as, for example, one or more keypads, one or more voice-recognition systems, one or more touch-screen displays and/or any combination thereof. In several exemplary embodiments, the control panel 18 includes one or more output devices such as, for example, one or more displays such as, for example, one or more digital displays, one or more liquid crystal displays and/or any combination thereof, one or more printers and/or any combination thereof. In several exemplary embodiments, the control panel 18 includes one or more card readers, one or more graphical-user interfaces and/or other types of user interfaces, one or more digital ports, one or more analog ports, one or more signal ports, one or more alarms, and/or any combination thereof. In several exemplary embodiments, the computer 40 and/or the processor 42 includes, for example, one or more of the following: a programmable general purpose controller, an application specific integrated circuit (ASIC), other controller devices and/or any combination thereof.

Figure 4:
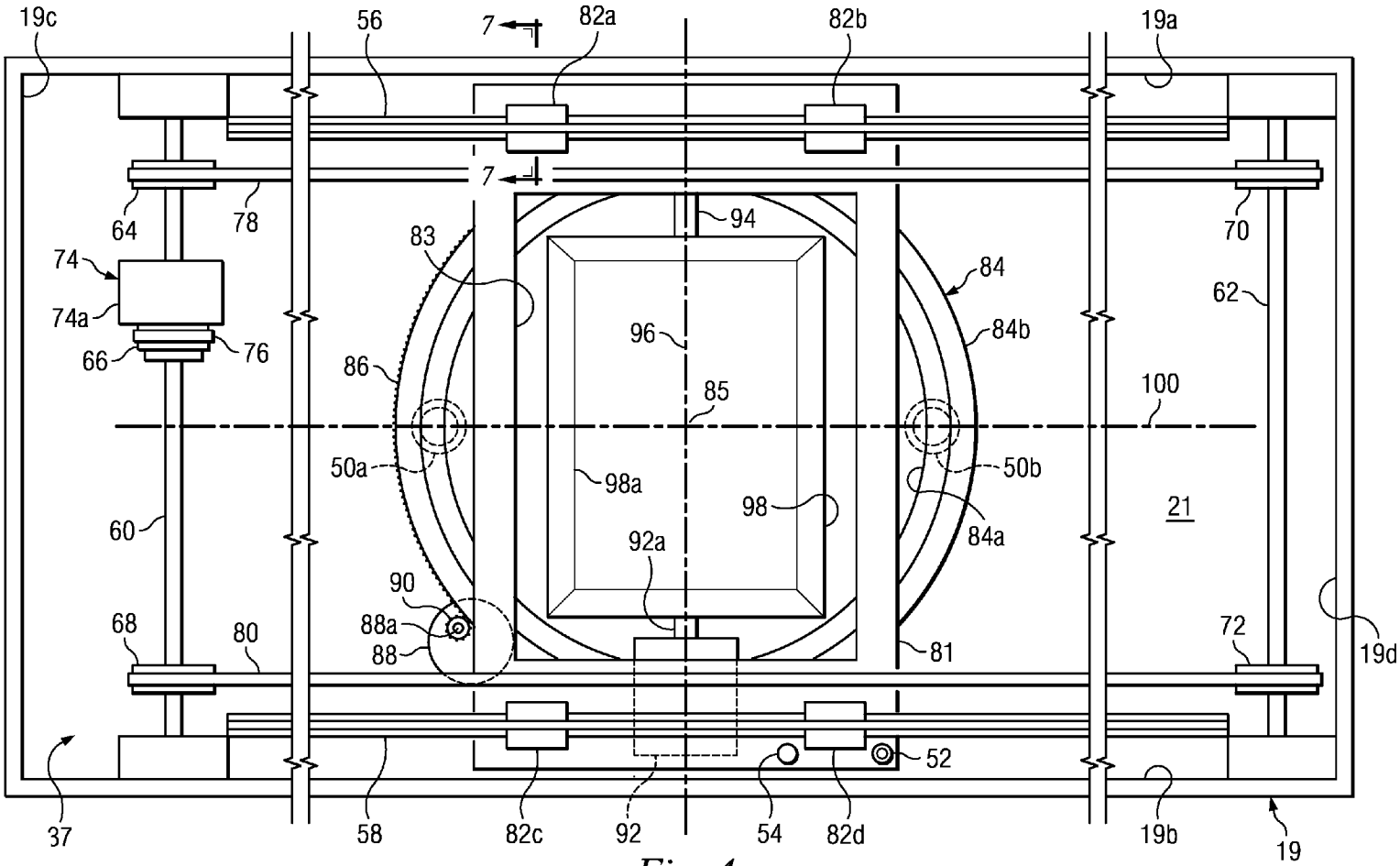
FIG. 4 is a diagrammatic illustration of a top plan view of the merchandiser of FIGS. 1 and 2 and the distribution and stacking system of FIG. 2, according to an exemplary embodiment.
Figure 5:
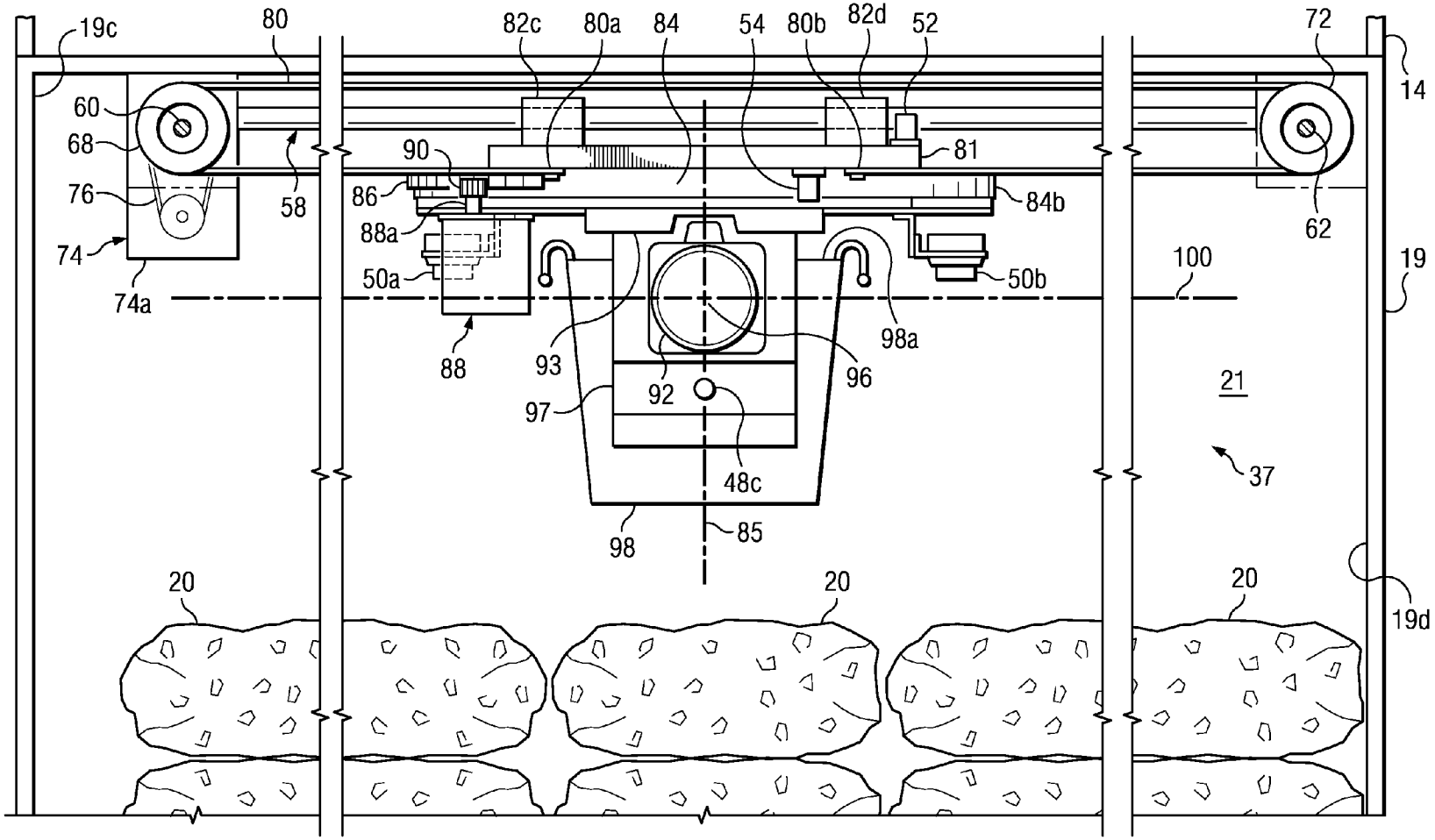
FIG. 5 is a diagrammatic illustration of a front elevational view of respective portions of the merchandiser of FIGS. 1, 2 and 4 and the distribution and stacking system of FIGS. 2 and 4, according to an exemplary embodiment.

In an exemplary embodiment, as illustrated in FIGS. 4 and 5 with continuing reference to FIGS. 1-3, the distribution and stacking system 37 includes a track member 56 which is coupled to the merchandiser 19, and extends within the region 21 between the left and right end portions of the merchandiser 19, as viewed in FIGS. 4 and 5. The track member 56 is generally parallel to, and proximate, an inside back wall 19*a* of the merchandiser 19. Similarly, a track member 58 is coupled to the merchandiser 19, and extends with the region 21 between the left and right end portions of the merchandiser 19. The track member 58 is generally parallel to, and proximate, an inside front wall 19*b* of the merchandiser 19, as well as the doors 22*a* and 22*b* when the doors are in their respective closed positions. The track members 56 and 58 are spaced in a generally parallel relation.

A rotatable shaft 60 is coupled to the merchandiser 19, and extends within the region 21 between the front and back portions of the merchandiser 19. The shaft 60 is generally parallel to, and proximate, an inside left wall 19*c* of the merchandiser 19. The shaft 60 is adapted to rotate in place about its longitudinal axis. Similarly, a rotatable shaft 62 is coupled to the merchandiser 19, and extends within the region 21 between the front and back portions of the merchandiser 19. The shaft 62 is generally parallel to, and proximate, an inside right wall 19*d* of the merchandiser 19. The shaft 62 is adapted to rotate in place about its longitudinal axis. The shafts 60 and 62 are spaced in a generally parallel relation. Gears 64, 66 and 68 are coupled to the shaft 60, and are adapted to rotate in place along with the shaft 60. Gears 70 and 72 are coupled to the shaft 62, and are adapted to rotate in place along with the shaft 62. A drive motor 74 is coupled to the merchandiser 19 at the left end portion thereof. The drive motor 74 includes a housing 74*a* through which the shaft 60 extends. A chain or toothed belt 76 is engaged with, and thus operably coupled to, each of the drive motor 74 and the gear 66. A chain or toothed belt 78 is engaged with, and thus operably coupled to, each of the gears 64 and 70. A chain or toothed belt 80 is engaged with, and thus operably coupled to, each of the gears 68 and 72.

A generally planar frame or carriage 81 is movably coupled to the merchandiser 19. More particularly, supports 82*a* and 82*b* are coupled to the back portion of the carriage 81. The track member 56 extends through the supports 82*a* and 82*b*. Similarly, supports 82*c* and 82*d* are coupled to the front portion of the carriage 81. The track member 58 extends through the supports 82*c* and 82*d*. An end portion 80*a* (shown in FIG. 5) of the belt 80 is coupled to the bottom side of the carriage 81 at the front left end portion thereof. Similarly, an end portion 80*b* (shown in FIG. 5) of the belt 80 is coupled to the bottom side of the carriage 81 at the front right end portion thereof. Although not shown in FIGS. 4 and 5, respective end portions of the belt 78 are similarly coupled to the bottom side of the carriage 81 at the back left and right end portions thereof, respectively. The carriage 81 is movable along the track members 56 and 58. A generally rectangular through-opening 83 is formed through the carriage 81. The home position sensor 52 is coupled to the carriage 81 at the front right corner thereof and extends upward therefrom, as viewed in FIGS. 4 and 5. The home rotate sensor 54 is coupled to the carriage 81 at the front portion thereof and to the left of the home position sensor 52, as viewed in FIGS. 4 and 5. The home rotate sensor 54 extends downward from the carriage 81.

A ring bearing 84 is coupled to the underside of the carriage 81. The ring bearing 84 includes an inner ring 84*a* and an outer ring 84*b* coupled thereto and circumferentially extending thereabout. The ring bearing 84 is configured to permit relative rotation between the rings 84*a* and 84*b* about a common center axis 85, which is generally parallel to the walls 19*a*, 19*b*, 19*c* and 19*d*, and to the doors 22*a* and 22*b* when they are in their respective closed positions. The outer ring 84*b* of the ring bearing 84 is coupled to the underside of the carriage 81. Thus, the inner ring 84*a* is permitted to rotate in place, about the axis 85 and relative to the outer ring 84*b* and the carriage 81.

A circumferentially-extending gear track 86 is coupled to the left side portion of the outer ring 84*b*, as viewed in FIGS. 4 and 5. A rotator motor 88 is coupled to the inner ring 84*a* and includes an output shaft 88*a*. A gear 90 is coupled to the output shaft 88*a* of the rotator motor 88. The gear 90 is engaged with, and thus operably coupled to, the gear track 86. A kicker motor 92 is coupled to the inner ring 84*a* of the ring bearing 84 via bracketry 93. The kicker motor 92 includes an output shaft 92*a*. A shaft 94 is coupled to the inner ring 84*a*, and is positioned generally diametrically opposite the position of the output shaft 92*a* of the kicker motor 92. The output shaft 92*a* and the shaft 94 are generally axially aligned along an axis 96. The axis 96 is generally perpendicular to the axis 85. The sensor 48*c* is coupled to the kicker motor 92 via a bracket 97, and is adapted to control at least in part the operation of the kicker motor 92, under conditions to be described below.

A basket 98 is coupled to the output shaft 92*a* so that the basket 98 is adapted to rotate about the axis 96 when the output shaft 92*a* is driven, under conditions to be described below. The basket 98 is also coupled to the shaft 94. The basket 98 defines a top opening 98*a*, which is positioned below the through-opening 83 when the carriage 81 is in its home position shown in FIGS. 4 and 5. As viewed in FIG. 4, the through-opening 83 surrounds the top opening 98*a* of the basket 98 when the basket 98 is positioned as shown in FIGS. 4 and 5, relative to the carriage 81. In an exemplary embodiment, the basket 98 is a wire basket. In several exemplary embodiments, the basket 98 is in the form or, or includes, any type of structure configured to hold or support one of the ice-filled bags 20 such as, for example, a horizontally-extending plate or panel, a U-shaped bracket, a rectangular frame configured with an open top and bottom, a box with an open top, etc. In several exemplary embodiments, the basket 98 is any type of container defining a top opening.

The stacking level sensor 50*a* is coupled to the inner ring 84*a* of the ring bearing 84. The stacking level sensor 50*b* is also coupled to the inner ring 84*a* so that the sensor 50*b* is positioned at a location that is generally diametrically opposite the location at which the stacking level sensor 50*a* is positioned. When the basket 98 is positioned as shown in FIGS. 4 and 5, relative to the carriage 81, the stacking level sensors 50*a* and 50*b* are generally axially aligned along an axis 100, and are positioned about midway between the shafts 92*a* and 94. The axis 100 is generally perpendicular to the axis 85.

In an exemplary embodiment, each of the stacking level sensors 50*a* and 50*b* is an analog sensor. In an exemplary embodiment, each of the stacking level sensors 50*a* and 50*b* is an ultrasonic sensor that includes an analog output. In an exemplary embodiment, each of the stacking level sensors 50*a* and 50*b* is a U-GAGE T30 Series Ultrasonic Sensor, Model T30UUNAQ, which is available from Banner Engineering Corp., Minneapolis, Minn. USA.

Figure 6:
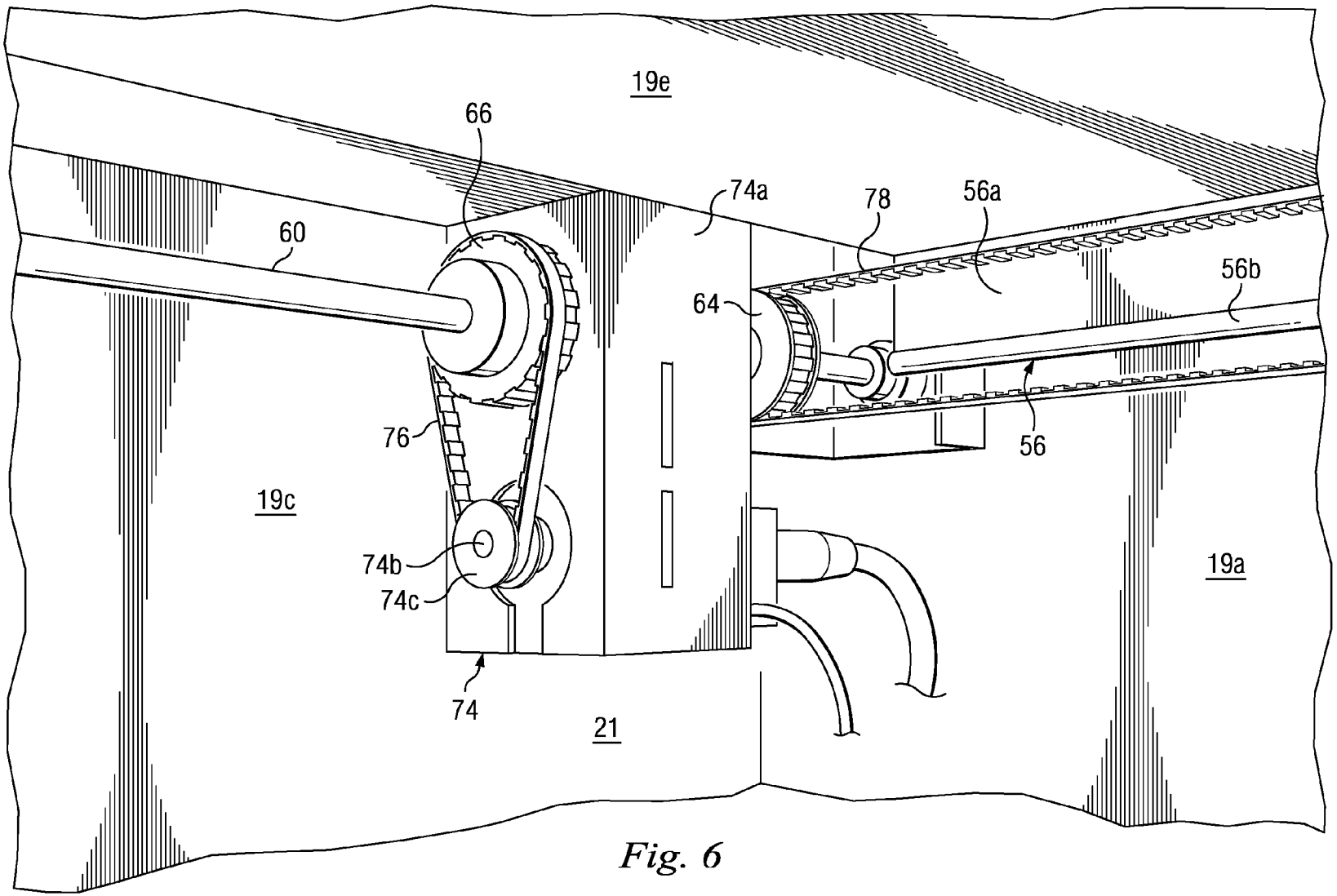
FIG. 6 is a perspective view of respective portions of the merchandiser of FIGS. 1, 2, 4 and 5 and the distribution and stacking system of FIGS. 2, 4 and 5, according to an exemplary embodiment.

In an exemplary embodiment, as illustrated in FIG. 6 with continuing reference to FIGS. 1-5, the track member 56 includes a vertically-extending wall 56*a* and a cylindrical rod portion 56*b* extending along the bottom edge of the wall 56*a*. The wall 56*a* is coupled to an inside top wall 19*e* of the merchandiser 19. The housing 74*a* of the drive motor 74 extends downward from the inside top wall 19*e*. The drive motor 74 further includes an output shaft 74*b*, to which a gear 74*c* is coupled. The belt 76 is engaged with, and thus operably coupled to, the gear 74*c* of the drive motor 74, as well as being engaged with, and thus operably coupled to, the gear 66, as noted above.

Figure 7:
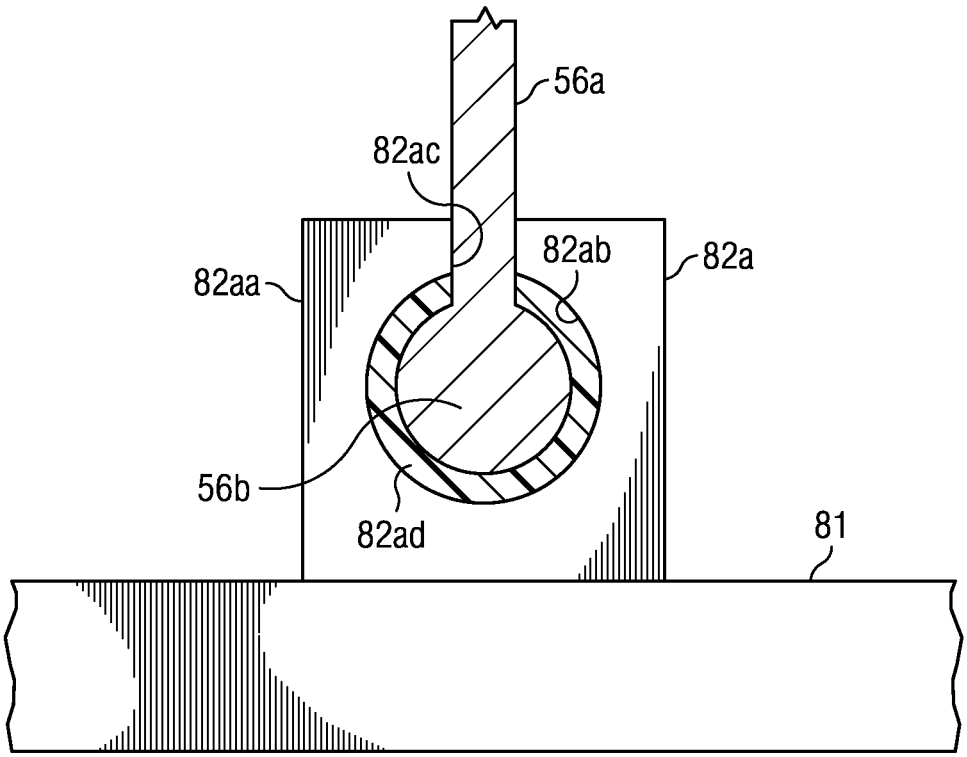
FIG. 7 is a section view of a portion of the distribution and stacking system of FIGS. 2 and 4-6 taken along line 7-7 of FIG. 4, according to an exemplary embodiment.

In an exemplary embodiment, as illustrated in FIG. 7 with continuing reference to FIGS. 1-6, the support 82*a* includes a block 82*aa* and a through-opening 82*ab* formed therethrough. A slot 82*ac* is formed in the top of the block 82*aa* and extends thereacross and into the through-opening 82*ab*. The rod portion 56*b* of the track member 56 extends through the through-opening 82*ab*, and the wall 56*a* extends through the slot 82*c*, thereby coupling the support 82*a* to the track member 56. In an exemplary embodiment, a liner 82*ad* radially extends between the rod portion 56*b* and the curved surface of the block 82*aa* defined by the through-opening 82*ab*. The support 82*b* is substantially identical to the support 82*a*, and is coupled to the track member 56 in a manner substantially identical to the above-described manner by which the support 82*a* is coupled to the track member 56.

Figure 8:
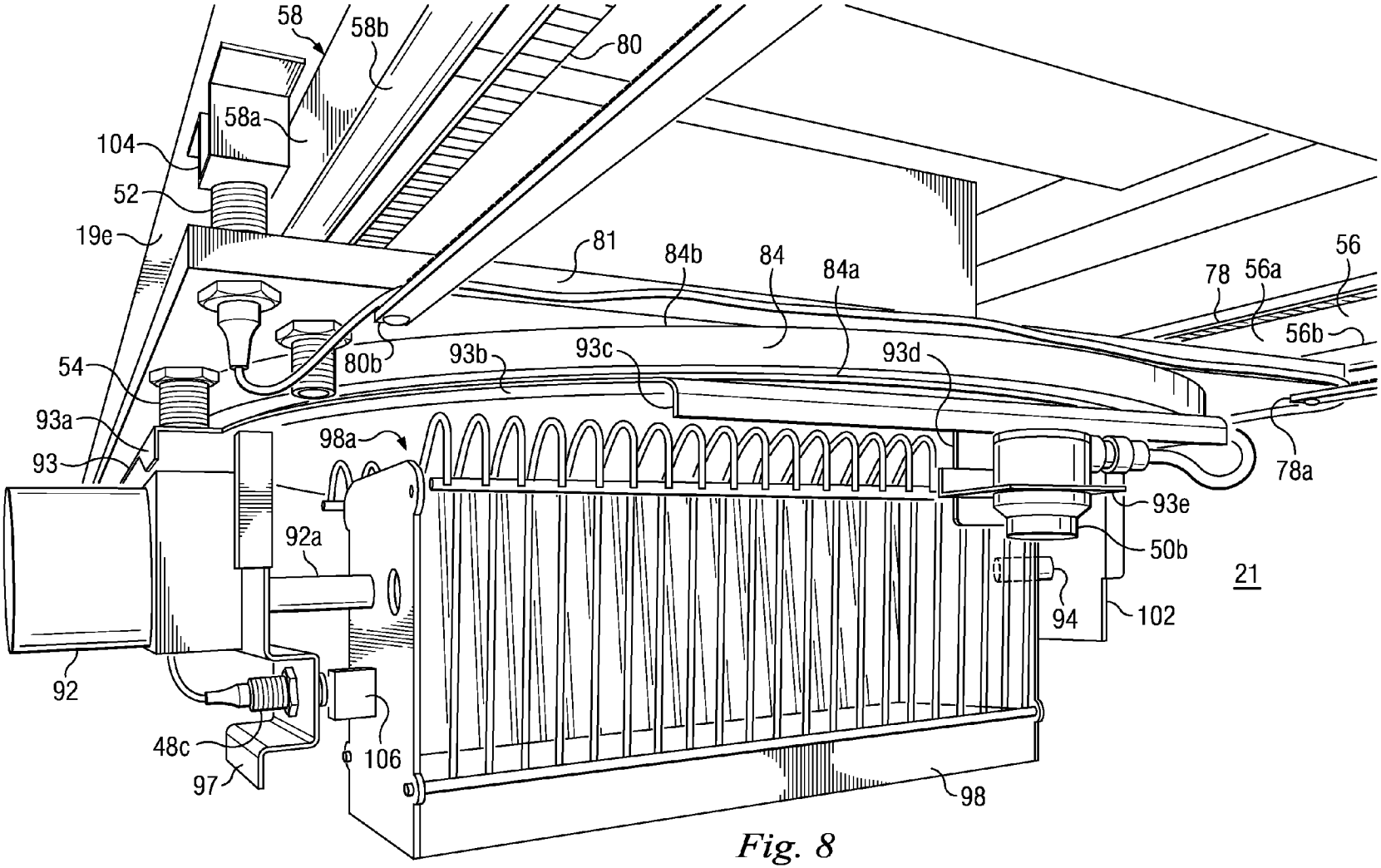
FIG. 8 is a perspective view of other respective portions of the merchandiser of FIGS. 1, 2 and 4-6 and the distribution and stacking system of FIGS. 2 and 4-7, according to an exemplary embodiment.

In an exemplary embodiment, as illustrated in FIG. 8 with continuing reference to FIGS. 1-7, the track member 58 is substantially identical to the track member 56. Thus, the track member 58 includes a vertically-extending wall 58*a* and a cylindrical rod portion 58*b* extending along the bottom edge of the wall 58*a*. Each of the supports 82*c* and 82*d* (not shown in FIG. 8) are coupled to the track member 58 in a manner substantially identical to the above-described manner by which the support 82*a* is coupled to the track member 56.

The shaft 94 is coupled to the inner ring 84*a* via at least a downwardly-extending bracket 102, which is coupled to the inner ring 84*a*. A home position bracket 104 is coupled to the inside top wall 19*e*. The home position sensor 52 is registered or otherwise aligned with the home position bracket 104 when the carriage 81 is in the position shown in FIGS. 4 and 5. As shown in FIG. 8, the bracket 97 is coupled to the bracketry 93. As noted above, the bracketry 93 is coupled to the inner ring 84*a* of the ring bearing 84. As shown in FIG. 8, the bracketry 93 includes a horizontally-extending portion 93*a* that extends above the kicker motor 92. A curved portion 93*b* of the bracketry 93 extends from the horizontally-extending portion 93*a* and along the inner ring 84*a*. A generally straight portion 93*c* extends from the curved portion 93*b* in a direction that is generally parallel to the axis 96 (not shown). The straight portion 93*c* includes a downwardly-extending bend to which a vertically-extending bracket 93*d* is coupled. A right-angle bracket 93*e* is coupled to the vertically-extending bracket 93*d*. The sensor 50*b* is coupled to the right-angle bracket 93*e*.

The home rotate sensor 54 is registered or otherwise aligned with the right end portion of the horizontally-extending portion 93*a* of the bracketry 93 when the basket 98 is positioned as shown in FIGS. 4, 5 and 8, relative to the carriage 81. A tab 106 extends from the side of the basket 98 that is coupled to the output shaft 92*a* of the kicker motor 92. The sensor 48*c* is registered or otherwise aligned with the tab 106 when the basket 98 is positioned as shown in FIGS. 4, 5 and 8, relative to the bracket 97 and the kicker motor 92. As shown in FIG. 8, an end portion 78*a* of the belt 78 is coupled to the bottom side of the carriage 81 at the back right end portion thereof, as viewed in FIGS. 4, 5 and 8. The end portion 78*a* is equivalent to the end portion 80*b* of the belt 80, which as noted above is coupled to the bottom side of the carriage 81 at the front right end portion thereof, as viewed in FIGS. 4, 5 and 8. Another end portion of the belt 78, which is not shown in FIG. 8, is coupled to the bottom side of the carriage 81 at the back left end portion thereof, and is equivalent to the end portion 80*a* of the belt 80, which as noted above is coupled to the bottom side of the carriage 81 at the front left end portion thereof, as viewed in FIGS. 4, 5 and 8.

Figure 9:
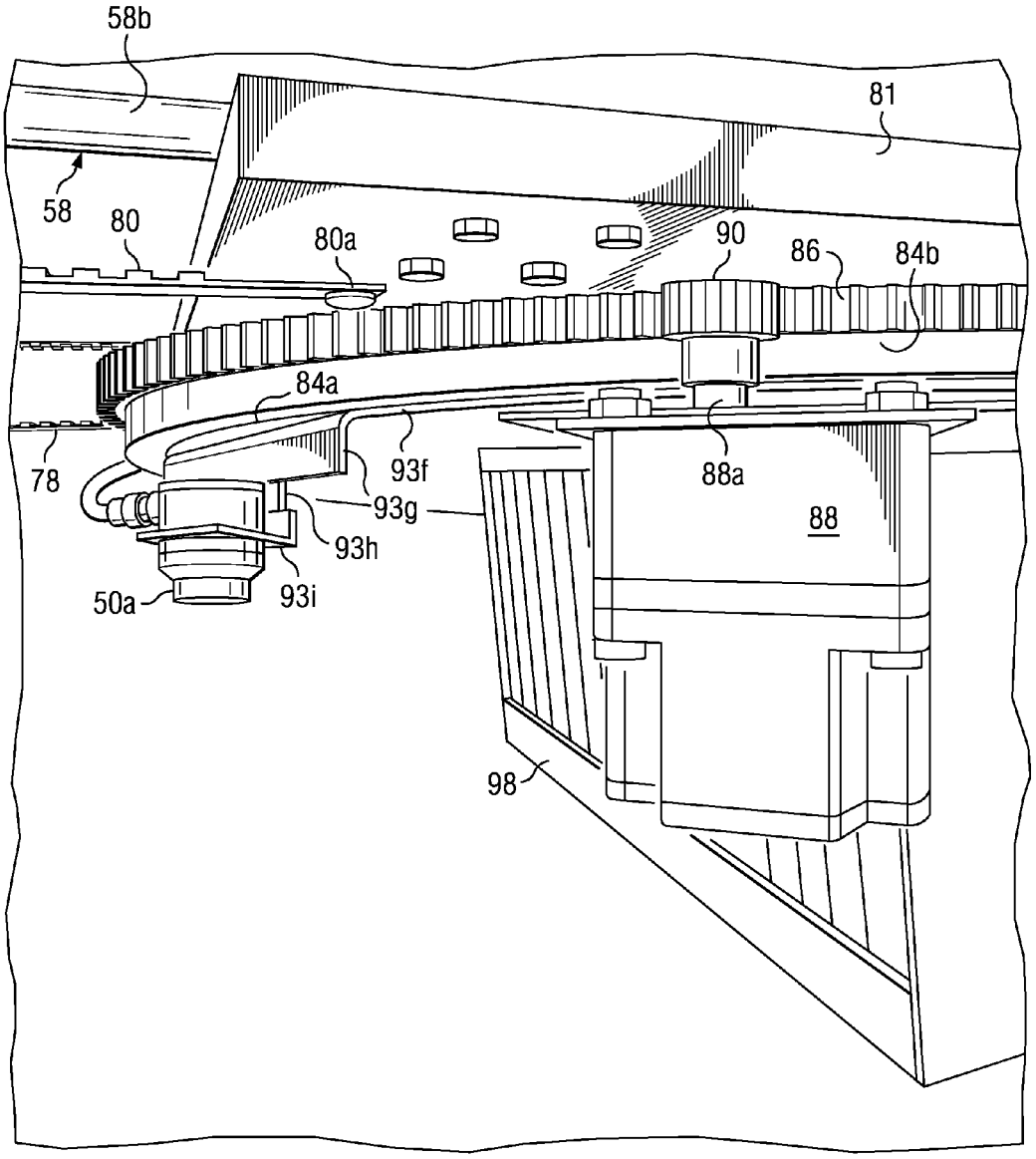
FIG. 9 is a perspective view of yet other respective portions of the merchandiser of FIGS. 1, 2, 4-6 and 8 and the distribution and stacking system of FIGS. 2 and 4-8, according to an exemplary embodiment.

In an exemplary embodiment, as illustrated in FIG. 9 with continuing reference to FIGS. 1-8, the bracketry 93 further includes a curved portion 93*f*, which extends from the horizontally-extending portion 93*a* and is symmetric to the curved portion 93*b* about the axis 96 (not shown). A generally straight portion 93*g* extends from the curved portion 93*f* in a direction that is generally parallel to the axis 96 (not shown). The straight portion 93*g* includes a downwardly-extending bend to which a vertically-extending bracket 93*h* is coupled. A right-angle bracket 93*i* is coupled to the vertically-extending bracket 93*h*. The sensor 50*a* is coupled to the right-angle bracket 93*i*. In an exemplary embodiment, instead of, or in addition to the vertically-extending bracket 93*h* and the downwardly-extending bend of the generally straight portion 93*g*, the bracketry 93 includes a curved guard which extends downward from the inner ring 84*a* so that the sensor 50*a* is radially positioned between the axis 85 and the curved guard;

in an exemplary embodiment, the right-angle bracket 93*i* is coupled to the curved guard, which is adapted to protect or guard the sensor 50*b* from contacting objects, such as the wall 19*a*, when the stacking level sensor 50*a* rotates relative to the carriage 81, under conditions to be described below. As shown in FIG. 9, the rotator motor 88 is coupled to the curved portion 93*f* of the bracketry 93, which is coupled to the inner ring 84*a*, as noted above.

Figure 10:
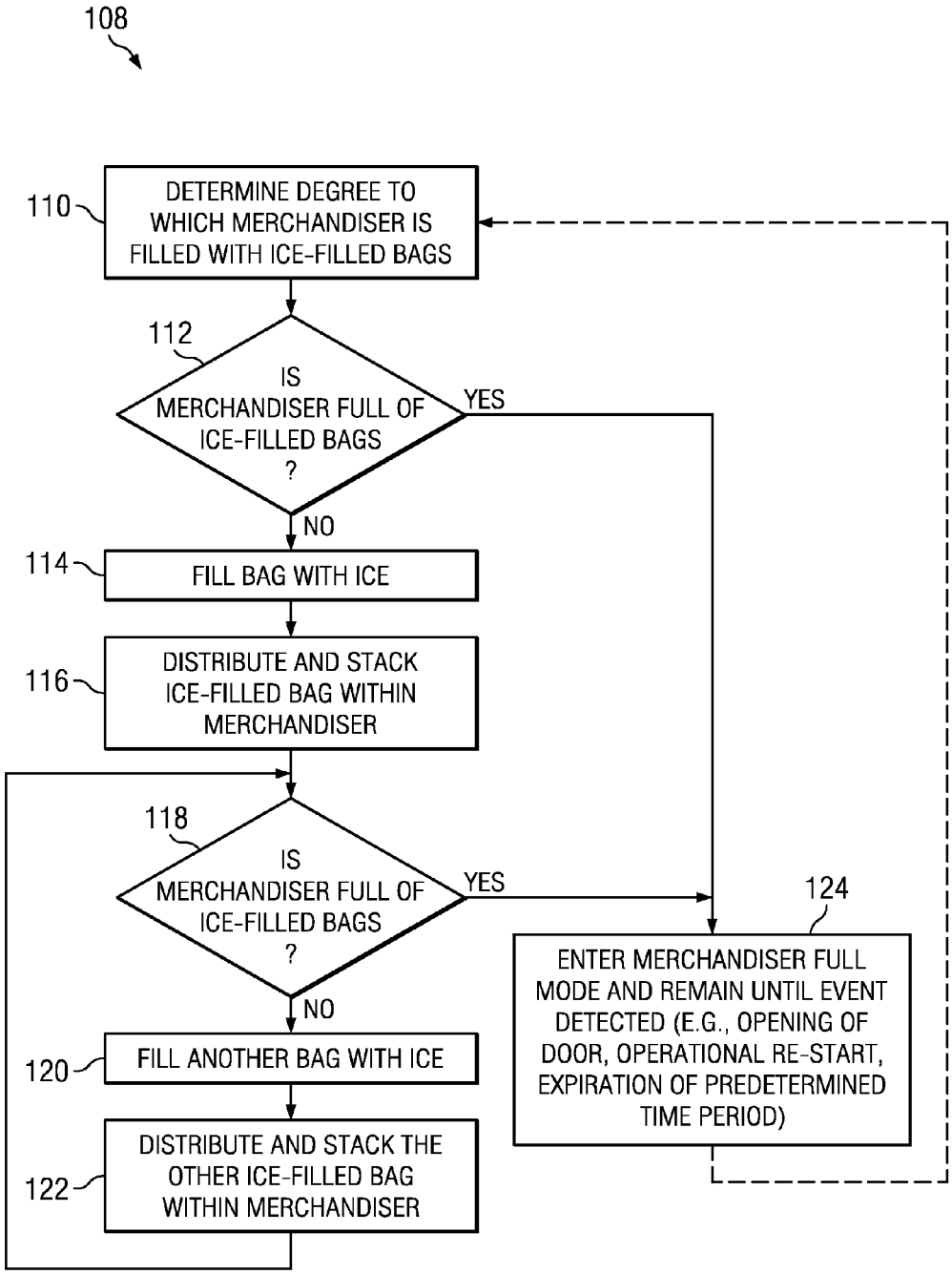
FIG. 10 is a flow chart illustration of a method of operating the apparatus of FIGS. 1-9, according to an exemplary embodiment.

In an exemplary embodiment, as illustrated in FIG. 10 with continuing reference to FIGS. 1-9, a method 108 of operating the apparatus 10 includes determining in step 110 the degree to which the region 21 of the merchandiser 19 is filled with the ice-filled bags 20, and determining in step 112 whether the region 21 of the merchandiser 19 is full of the ice-filled bags 20. If the region 21 is not full, then ice is automatically bagged, that is, a bag is automatically filled with ice in step 114 to thereby produce one of the ice-filled bags 20, and the one ice-filled bag 20 is distributed and stacked within the region 21 of the merchandiser 19 in step 116. In step 118, it is again determined whether the region 21 of the merchandiser 19 is full of the ice-filled bags 20. If not, then another bag is automatically filled with ice in step 120 to thereby produce another of the ice-filled bags 20, and the other ice-filled bag 20 is distributed and stacked within the region 21 of the merchandiser 19 in step 122. The steps 118, 120 and 122 are repeated until it is determined in the step 118 that the region 21 is full of the ice-filled bags 20.

As shown in FIG. 10, if it is determined in either the step 112 or the step 118 that the region 21 of the merchandiser 19 is full of the ice-filled bags 20, then in step 124 the apparatus 10 enters a "merchandiser full" mode. In the "merchandiser full" mode in the step 124, the apparatus 10 ceases automatically bagging any more ice, that is, producing any more of the ice-filled bags 20, and/or at least ceases introducing any more of the ice-filled bags 20 into the region 21 of the merchandiser 19. In an exemplary embodiment, the apparatus 10 remains in the "merchandiser full" mode in the step 124 until an event is detected, at which point the method 108 is repeated beginning with the step 110. In an exemplary embodiment, the detected event in the step 124 is the opening of one of the doors 22*a* and 22*b*, which opening may be detected by one of the sensors 23*a* and 23*b*. In an exemplary embodiment, the detected event in the step 124 is the operational re-start of the apparatus 10; for example, if the apparatus 10 ceases to be supplied with electrical power and then is re-supplied with electrical power so that the apparatus 10 is operationally re-started, then the method 108 may be repeated beginning with the step 110. In an exemplary embodiment, the detected event in the step 124 is the expiration of a predetermined amount of time such as, for example, one hour. In an exemplary embodiment, the method 108 is executed upon startup of the apparatus 10.

Figure 11:
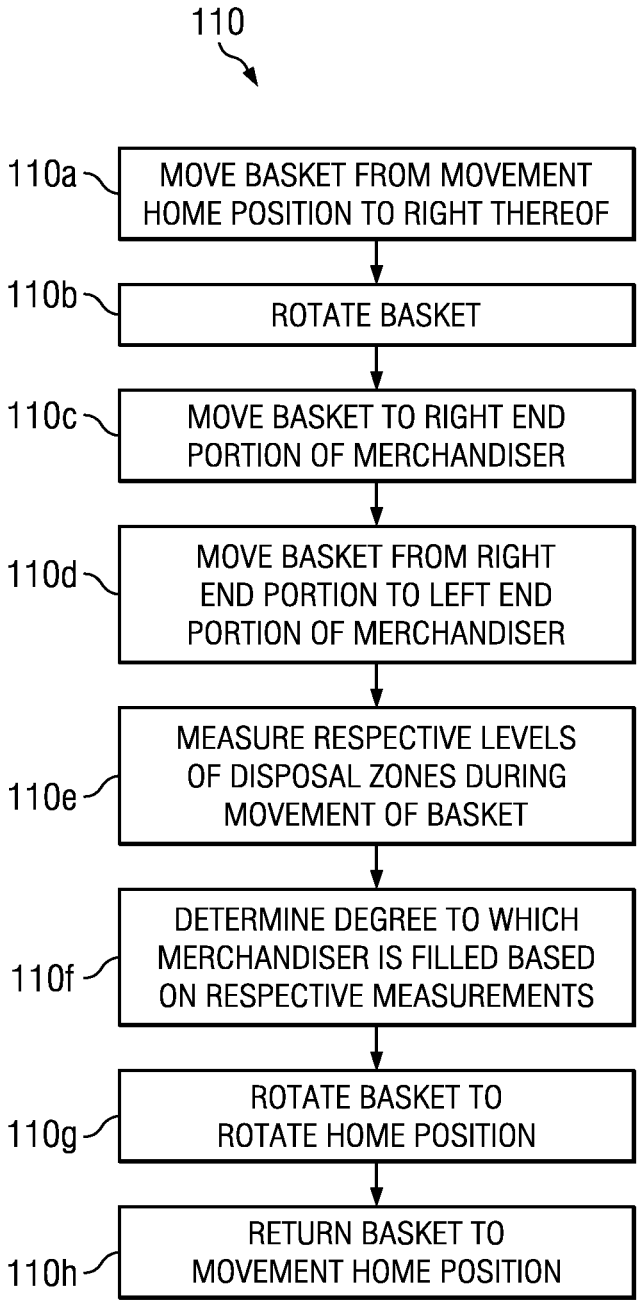
FIG. 11 is a flow chart illustration of a step of the method of FIG. 10, according to an exemplary embodiment.

In an exemplary embodiment, as illustrated in FIG. 11 with continuing reference to FIGS. 1-10, to determine the degree to which the region 21 of the merchandiser 19 is filled with the ice-filled bags 20 in the step 110 of the method 108, the basket 98 is moved in step 110*a* from its movement home position shown in FIGS. 4, 5, 8 and 9 to the right thereof. In step 110*b*, the basket 98 is then rotated ninety degrees from its rotate home position shown in FIGS. 4, 5, 8 and 9. In step 110*c*, the basket 98 is then moved to the right end portion of the region 21 of the merchandiser 19. In step 110*d*, the basket 98 is moved from the right end portion of the region 21 of the merchandiser 19 to the left end portion of the region 21. During the step 110*d*, respective stacking levels of disposal zones 126*a-j* (shown in FIG. 12) are measured in step 110*e*. Before, during and/or after the steps 110*d* and/or 110*e*, in step 110*f* the degree to which the region 21 is filled with the ice-filled bags 20 is determined based on the respective measurements made in the step 110*e*. Before, during and/or after the step 110*f*, in step 110*g* the basket 98 is rotated back to its home rotate position shown in FIGS. 4, 5, 8 and 9. Before, during and/or after the steps 110*f* and/or 110*g*, in step 110*h* the basket 98 is moved back to its movement home position shown in FIGS. 4, 5, 8 and 9.

Figure 12:
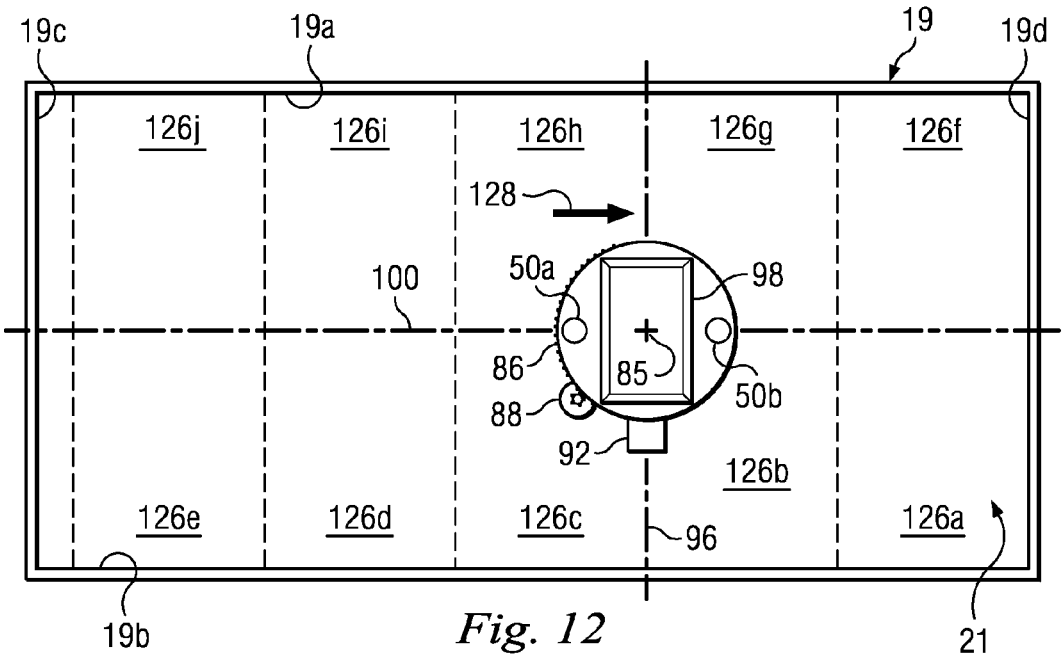
FIGS. 12-15 are diagrammatic illustrations of top plan views of respective portions of the merchandiser of FIGS. 1, 2, 4-6, 8 and 9 and the distribution and stacking system of FIGS. 2 and 4-9 during the execution of the step of FIG. 11, according to an exemplary embodiment.

In an exemplary embodiment, as illustrated in FIG. 12 with continuing reference to FIGS. 1-11, to move the basket 98 from its movement home position shown in FIGS. 4, 5, 8 and 9 to the right thereof in the step 110*a*, the drive motor 74 drives the gear 74*c* counterclockwise as viewed in FIG. 5. As a result, the belt 76 is driven, causing the gear 66—and thus the shaft 60 and the gears 64 and 68—to rotate counterclockwise as viewed in FIG. 5, thereby driving the belts 78 and 80. During the driving of the belts 78 and 80, the gears 70 and 72 and thus the shaft 62 also rotate counterclockwise as viewed in FIG. 5. As a result, the carriage 81 and thus the basket 98 move to the right along the axis 100, as indicated by an arrow 128 in FIG. 12. In an exemplary embodiment, during the step 110*a*, the basket 98 moves approximately two feet.

As shown in FIG. 12, the region 21 of the merchandiser 19 includes the disposal zones 126*a-j*. In an exemplary embodiment, the disposal zones 126*a-j* are columns of space within the region 21 in which the ice-filled bags 20 may be stacked on top of one another. At any point in time, each of the disposal zones 126*a-j* may not have any of the ice-filled bags 20 stacked therein, may be partially filled with at least some of the ice-filled bags 20 stacked therein, or may be completed filled with at least some of the ice-filled bags 20 stacked therein.

Figure 13:
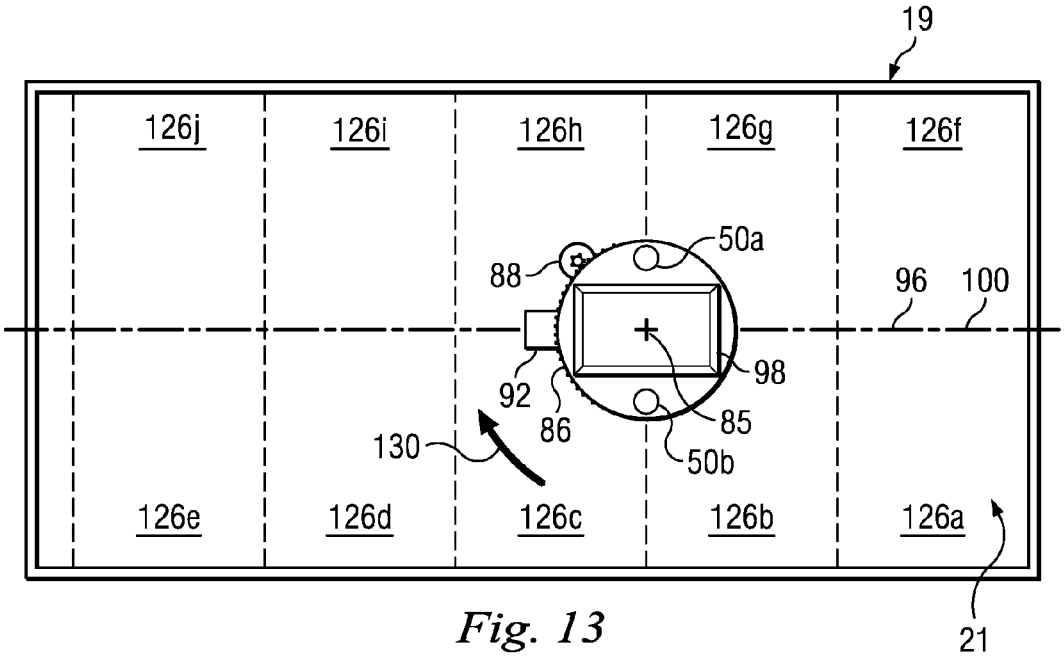

In an exemplary embodiment, as illustrated in FIG. 13 with continuing reference to FIGS. 1-12, to rotate the basket 98 ninety degrees from its rotate home position shown in FIGS. 4, 5, 8 and 9 in the step 110*b*, the rotator motor 88 drives the gear 90 clockwise as shown in FIG. 13. Due to the engagement between the gear 80 and the stationary gear track 86, the gear 90 and thus the rotator motor 88 travel clockwise, as viewed in FIG. 13, along the stationary gear track 86. Since the rotator motor 88 is coupled to the inner ring 84*a*, the inner ring 84*a* also rotates clockwise as viewed in FIG. 13, about the axis 85 and relative to the outer ring 84*b* and thus to the stationary gear track 86 and the carriage 81. Since the kicker motor 92 and the basket 98 are coupled to the inner ring 84*a*, the kicker motor 92 and the basket 98 also rotate clockwise as viewed in FIG. 13, about the axis 85 and relative to the outer ring 84*b* and thus to the stationary gear track 86 and the carriage 81, as indicated by an arrow 130 in FIG. 13. The basket 98 rotates ninety degrees clockwise; at the completion of the rotation, the axis 96 is coaxial with, or generally parallel to, the axis 100.

Figure 14:
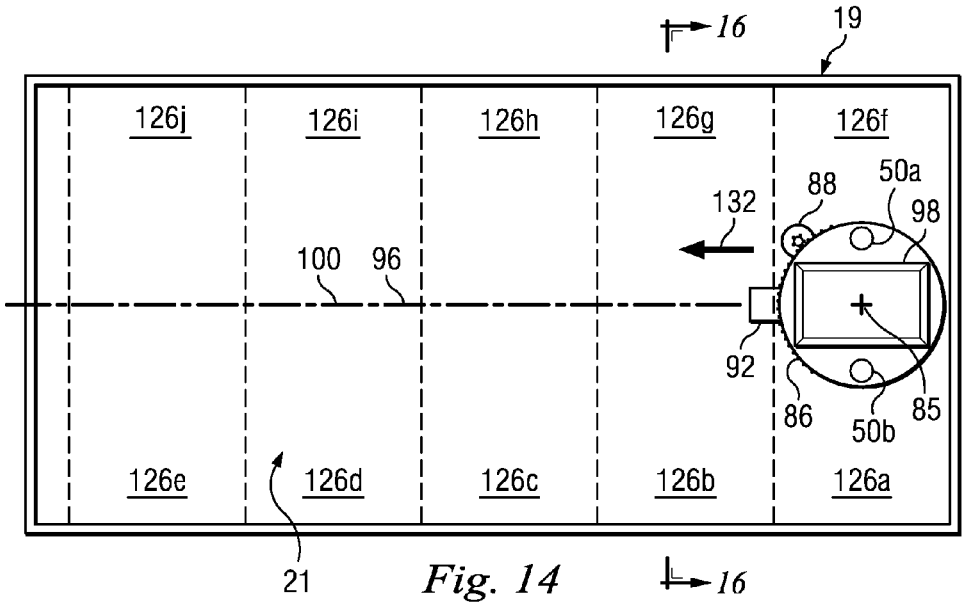

In an exemplary embodiment, as illustrated in FIGS. 13 and 14 with continuing reference to FIGS. 1-12, to move the basket 98 to the right end portion of the region 21 of the merchandiser 19 in the step 110*c*, the drive motor 74 drives the gear 74*c* counterclockwise as viewed in FIG. 5. As a result, the belt 76 is driven, causing the gear 66—and thus the shaft 60 and the gears 64 and 68—to rotate counterclockwise as viewed in FIG. 5, thereby driving the belts 78 and 80. During the driving of the belts 78 and 80, the gears 70 and 72 and thus the shaft 62 also rotate counterclockwise as viewed in FIG. 5. As a result, the carriage 81 and thus the basket 98 move to the right, along the axis 100 and all the way to the right end portion of the region 21 of the merchandiser 19, as viewed in FIG. 14.

In an exemplary embodiment, the step 110*a* is omitted and the step 110*b* is executed when the basket 98 is in its movement home position shown in FIGS. 4, 5, 8 and 9. In an exemplary embodiment, the step 110*a* is omitted and the step 110*b* is executed after the basket 98 has moved to the right end portion of the region 21 in the step 110*c*.

Figure 15:
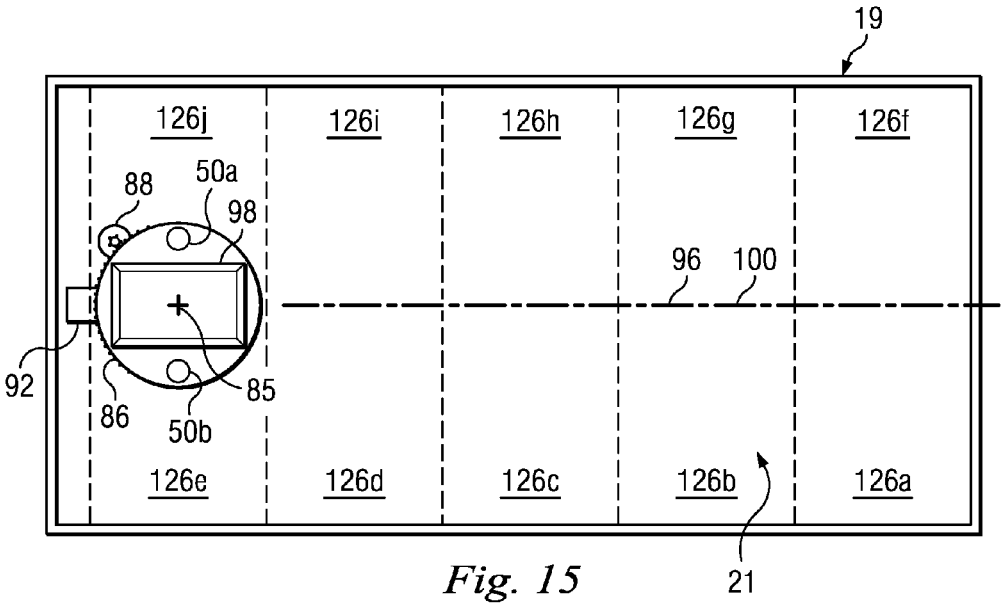

In an exemplary embodiment, as illustrated in FIGS. 14 and 15 with continuing reference to FIGS. 1-13, to move the basket 98 from the right end portion of the region 21 of the merchandiser 19 to the left end portion of the region 21 in the step 110*d*, the drive motor 74 drives the gear 74*c* clockwise as viewed in FIG. 5. As a result, the belt 76 is driven, causing the gear 66—and thus the shaft 60 and the gears 64 and 68—to rotate clockwise as viewed in FIG. 5, thereby driving the belts 78 and 80. During the driving of the belts 78 and 80, the gears 70 and 72 and thus the shaft 62 also rotate clockwise as viewed in FIG. 5. As a result, the carriage 81 and thus the basket 98 move to the left, as indicated by an arrow 132 in FIG. 14. The carriage 81 and thus the basket 98 move to the left along the axis 100 and all the way to the left end portion of the region 21 of the merchandiser 19, as viewed in FIG. 15.

Figure 16:
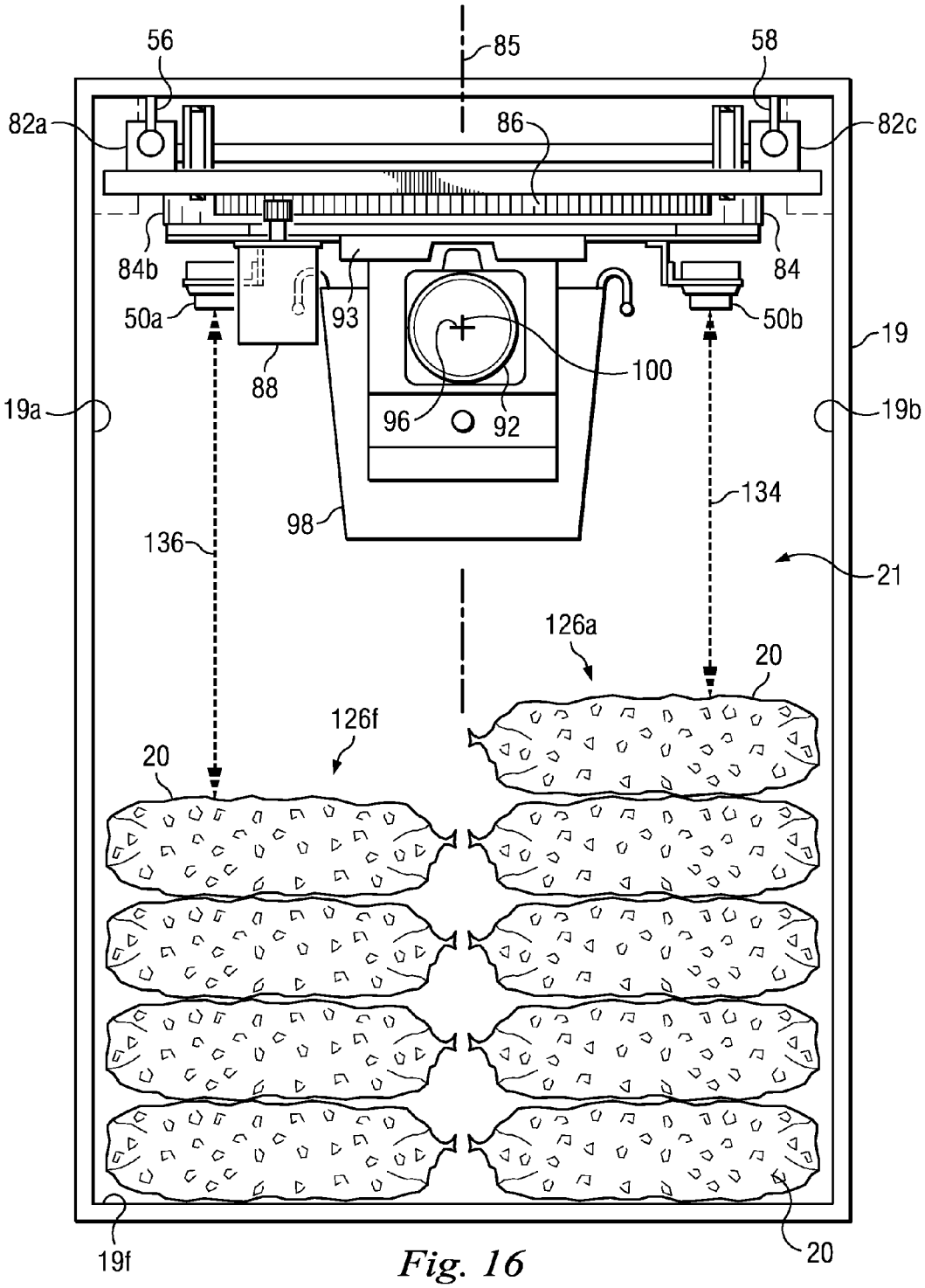
FIG. 16 is a diagrammatic illustration of a section view of respective portions of the merchandiser of FIGS. 1, 2, 4-6, 8 and 9 and the distribution and stacking system of FIGS. 2 and 4-9 taken along line 16-16 of FIG. 14, according to an exemplary embodiment.

In an exemplary embodiment, as illustrated in FIG. 16 with continuing reference to FIGS. 1-15, to measure the respective stacking levels of the disposal zones 126*a-j* in the step 110*e*, the respective stacking levels of the disposal zones 126*a-j* are measured using the sensors 50*a* and 50*b*. More particularly, as the basket 98 moves along the axis 100 from the right end portion to the left end portion of the region 21 of the merchandiser 19 in the step 110*d*, the sensor 50*b* is positioned above and moves across the disposal zones 126*a-e*, and the sensor 50*a* is positioned above and moves across the disposal zones 126*f*-126*j*. As the sensor 50*b* moves across each of the disposal zones 126*a-e*, the sensor 50*b* measures the respective stacking level of the disposal zone by taking a plurality of stacking level measurements during the movement of the sensor 50*b* across the disposal zone, and then determines the average of the measurements, the average measurement being the respective stacking level of the disposal zone. Similarly, as the sensor 50*a* moves across each of the disposal zones 126*f-j*, the sensor 50*a* measures the respective stacking level of the disposal zone by taking a plurality of stacking level measurements during the movement of the sensor 50*a* across the disposal zone, and then determines the average of the measurements, the average measurement being the respective stacking level of the disposal zone. In an exemplary embodiment, each of the sensors 50*a* and 50*b* takes ten measurements per each disposal zone 126*a-e* and 126*f-j*, respectively.

For example, as shown in FIG. 16, the sensor 50*b* takes a stacking level measurement of the disposal zone 126*a*, and the sensor 50*a* takes a stacking level measurement of the disposal zone 126*f*. In an exemplary embodiment, the stacking level measurement taken by the sensor 50*b* is, or is at least based on or a function of, a distance 134 between the sensor 50*b* and the topmost ice-filled bag 20 stacked in the disposal zone 126*a*. Similarly, the stacking level measurement taken by the sensor 50*a* is, or is at least based on or a function of, a distance 136 between the sensor 50*a* and the topmost ice-filled bag 20 stacked in the disposal zone 126. In an exemplary embodiment, the sensors 50*a* and 50*b* take respective stacking level measurements of the disposal zones 126*f* and 126*a*, respectively, by calculating the height of the respective stacks or columns of ice-filled bags 20 by subtracting the respective distances 136 and 134 from a predetermined distance such as, for example, the vertical distance between a bottom wall 19*f* of the merchandiser 19 and the sensors 50*a* and 50*b*; in an exemplary embodiment, these calculations are carried out, at least in part, by one or more of the computer 40 and the sensors 50*a* and 50*b*.

In an exemplary embodiment, to determine the degree to which the region 21 of the merchandiser 19 is filled with the ice-filled bags 20 in the step 110*f*, the percentage of a predetermined volume of the region 21 that is filled with the ice-filled bags 20 is calculated based on the measurements taken in the step 110*e*. In an exemplary embodiment, this calculation is carried out, at least in part, by one or more of the computer 40 and the sensors 50*a* and 50*b*. In an exemplary embodiment, the predetermined volume of the region 21 is the total volume of space within the region 21 in which the ice-filled bags 20 may be disposed.

Figure 17:
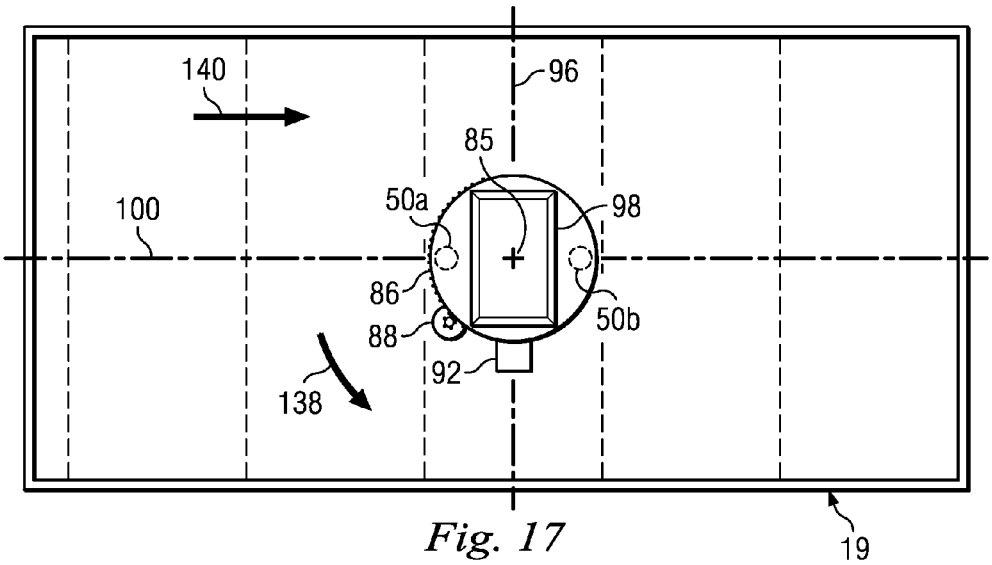
FIG. 17 is a diagrammatic illustration similar that of any of FIGS. 12-15 but depicting the respective portions of the merchandiser and the distribution and stacking system in a different operational mode during the execution of the step of FIG. 11, according to am exemplary embodiment.

In an exemplary embodiment, as illustrated in FIG. 17 with continuing reference to FIGS. 1-16, to rotate the basket 98 back to its rotate home position in the step 110*g*, the rotator motor 88 drives the gear 90 counterclockwise, as viewed in FIG. 17. Due to the engagement between the gear 80 and the stationary gear track 86, the gear 90 and thus the rotator motor 88 travel counterclockwise, as viewed in FIG. 17, along the stationary gear track 86. Since the rotator motor 88 is coupled to the inner ring 84*a*, the inner ring 84*a* also rotates counterclockwise as viewed in FIG. 17, about the axis 85 and relative to the outer ring 84*b* and thus to the stationary gear track 86 and the carriage 81. Since the kicker motor 92 and the basket 98 are coupled to the inner ring 84*a*, the kicker motor 92 and the basket 98 also rotate counterclockwise as viewed in FIG. 17, about the axis 85 and relative to the outer ring 84*b* and thus to the stationary gear track 86 and the carriage 81, as indicated by an arrow 138 in FIG. 17. The basket 98 rotates ninety degrees counterclockwise; at the completion of the rotation, the axis 96 is generally perpendicular to the axis 100. In an exemplary embodiment, the basket 98 rotates in the step 110*g* until the rotate home sensor 54 is again registered or otherwise aligned with the right end portion of the horizontally-extending portion 93*a* of the bracketry 93 (FIG. 8). In an exemplary embodiment, after the basket 98 has stopped rotating in the step 110*g*, it is confirmed that the basket 98 has rotated back to its rotate home position by confirming, using the rotate home sensor 54, that the rotate home sensor 54 is again registered or otherwise aligned with the right end portion of the horizontally-extending portion 93*a* of the bracketry 93.

In an exemplary embodiment, as further illustrated in FIG. 17 with continuing reference to FIGS. 1-16, to move the basket 98 back to its movement home position in the step 110*h*, the drive motor 74 drives the gear 74*c* counterclockwise as viewed in FIG. 5. As a result, the belt 76 is driven, causing the gear 66—and thus the shaft 60 and the gears 64 and 68—to rotate counterclockwise as viewed in FIG. 5, thereby driving the belts 78 and 80. During the driving of the belts 78 and 80, the gears 70 and 72 and thus the shaft 62 also rotate counterclockwise as viewed in FIG. 5. As a result, the carriage 81 and thus the basket 98 move to the right along the axis 100, as indicated by an arrow 140 in FIG. 17. In an exemplary embodiment, the basket 98 moves to the right in the step 110*h* until the home position sensor 52 is again registered or otherwise aligned with the home position bracket 104 (FIG. 8). In an exemplary embodiment, after the basket 98 has moved back to its movement home position in the step 110*h*, it is confirmed that the basket 98 has moved back to its movement home position by confirming, using the home position sensor 52, that the home position sensor 52 is again registered or otherwise aligned with the home position bracket 104.

As a result of the step 110, the merchandiser 19 is scanned to determine the bagged ice level within the merchandiser 19.

In an exemplary embodiment, to determine whether the region 21 of the merchandiser 19 is full of the ice-filled bags 20 in the step 112, it is determined whether the degree to which the region 21 is filled with ice-filled bags 20 is equal to or greater than a predetermined percentage. The degree determined in the step 110*f* is compared with the predetermined percentage in the step 112 to determine whether the degree determined in the step 110*f* is equal to or greater than the predetermined percentage. If so, then it is determined in the step 112 that the region 21 is full of the ice-filled bags 20. If not, then it is determined in the step 112 that the region 21 is not full of the ice-filled bags 20. In an exemplary embodiment, the predetermined percentage is 98%. In an exemplary embodiment, the predetermined percentage is 50% or some other percentage.

Figure 18:
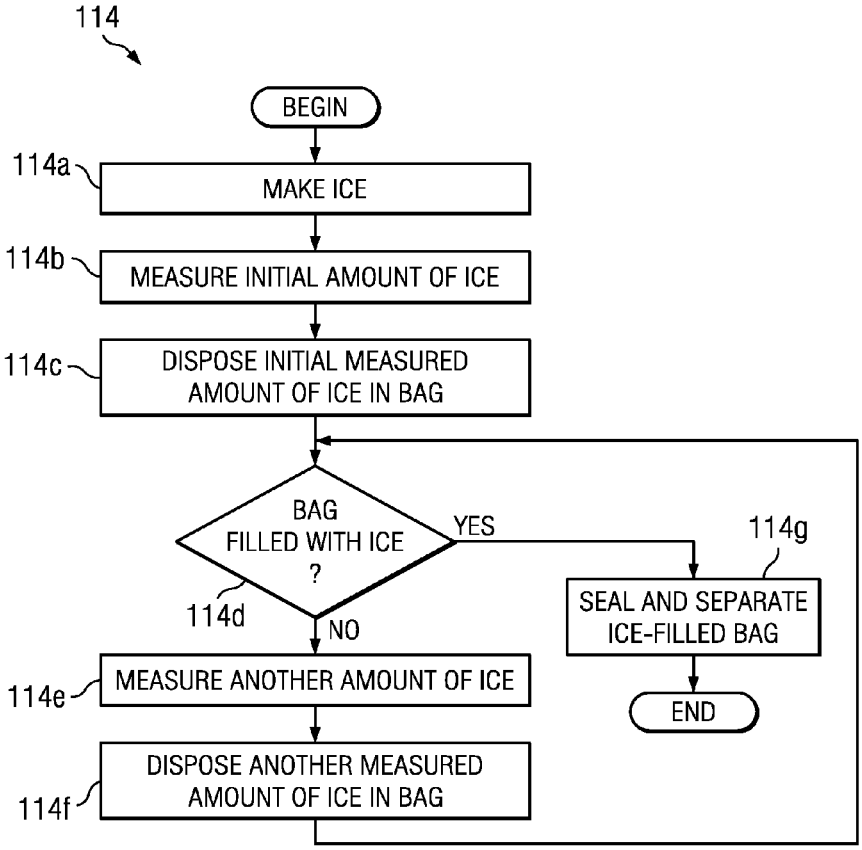
FIG. 18 is a flow chart illustration of another step of the method of FIG. 10, according to an exemplary embodiment.

In an exemplary embodiment, as illustrated in FIG. 18 with continuing reference to FIGS. 1-17, to fill a bag with ice to thereby produce one of the ice-filled bags 20 in the step 112, the ice is made in step 114*a*. In an exemplary embodiment, the ice is made in the step 114*a* before, during or after one or more of the steps of the method 108. In an exemplary embodiment, the ice is made in the step 114*a* using the ice maker 12*a* and/or the ice maker 12*b*. After the ice is made in the step 114*a*, an initial amount of ice is measured in step 114*b*, and the initial measured amount of ice is automatically disposed in the bag in step 114*c*, the bag being at least partially disposed in the basket 98 during the automatic disposal of the ice therein. In an exemplary embodiment, the initial amount of ice is automatically measured and disposed in the bag in the steps 114*b* and 114*c* using the hopper 32, the measurement system 34, and the bagging system 36, with the hopper 32 receiving the ice from the ice maker 12*a* and/or 12*b*, the measurement system 34 automatically measuring and delivering an amount of the ice into the bag at least partially disposed in the basket 98, and the bagging system 36 automatically providing the bag and at least partially disposed the bag in the basket 98 via the top opening 98*a* of the basket 98. The basket 98 may be characterized as part of both the bagging system 36 and the distribution and stacking system 37. After the step 114*c*, it is determined whether the bag is filled with ice in step 114*d*. If not, then another amount of ice is automatically measured in step 114*e*, and the other measured amount of ice is automatically disposed in the bag in step 114*f* using the hopper 32 and the measurement system 34. The steps 114*d*, 114*e* and 114*f* are repeated until the bag is filled with ice. In step 114*g*, the bagging system 36 then seals and separates the bag at least partially disposed in the basket 98 from the remainder of the bags (if any), thereby producing the one of the ice-filled bags 20, hereafter referred to by the reference numeral 20*a* (shown in FIG. 20).

In an exemplary embodiment, the bagging system 36 includes a static heat seal bar (not shown), which heat seals the bag in the step 114*g*. In an exemplary embodiment, the sensor 48*d* is used to control, at least in part, the sealing of the bag in the step 114*g*. In an exemplary embodiment, the determination of whether the bag is filled with ice in the step 114*d* is based on whether the bag is filled with a desired amount of ice. For example, the bag may be filled with ice if the internal volume defined by the bag is 25%, 50%, 75% or 100% full of ice. During the step 114, the basket 98 is in its movement home position and in its rotate home position, as shown in FIGS. 4, 5, 8 and 9. During at least the steps 114*c* and 114*f*, the ice falls through the through-opening 83 of the carriage 81 and into the bag at least partially disposed in the basket 98.

Figure 19:
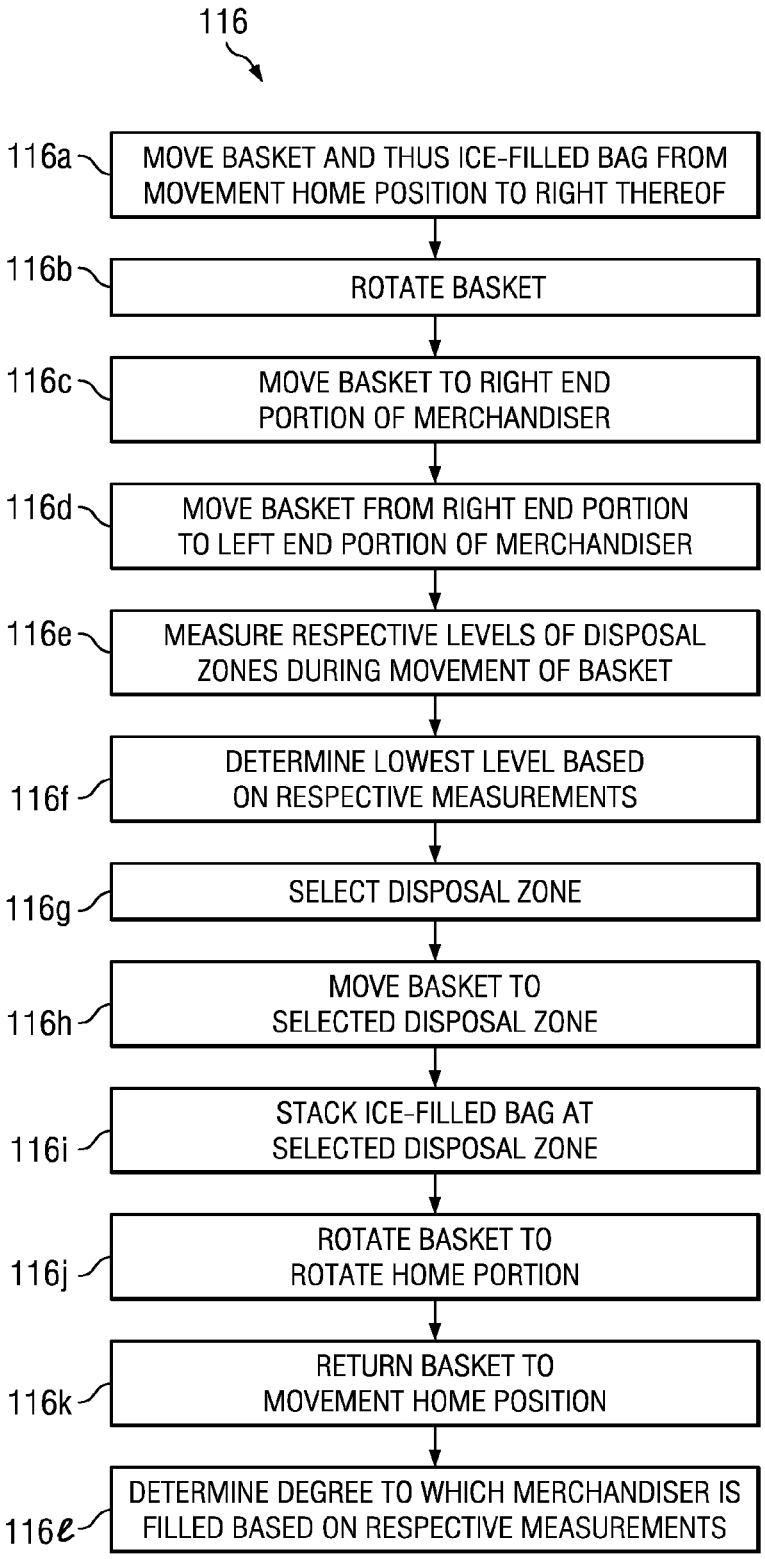
FIG. 19 is a flow chart illustration of yet another step of the method of FIG. 10, according to an exemplary embodiment.

In an exemplary embodiment, as illustrated in FIG. 19 with continuing reference to FIGS. 1-18, to distribute and stack the ice-filled bag 20*a* within the region 21 of the merchandiser 19 in the step 116, the basket 98—in which the ice-filled bag 20*a* is disposed—is moved in the step 116*a* from the basket 98's movement home position shown in FIGS. 4, 5, 8 and 9 to the right thereof. In step 116*b*, the basket 98 is then rotated ninety degrees from its rotate home position shown in FIGS. 4, 5, 8 and 9. In step 116*c*, the basket 98 and thus the ice-filled bag 20*a* are moved to the right end portion of the region 21 of the merchandiser 19. In step 116*d*, the basket 98 and thus the ice-filled bag 20*a* are moved from the right end portion of the region 21 of the merchandiser 19 to the left end portion of the region 21. During the step 116*d*, respective stacking levels of the disposal zones 126*a-j* are measured in step 116*e*. After the step 116*e*, the lowest stacking level of the respective stacking levels of the disposal zones 126*a-j* is determined in step 116*f*. One of the disposal zones 126*a-j* is selected in step 116*g*. In step 116*h*, the basket 98 and thus the ice-filled bag 20*a* are moved to the disposal zone 126*a-j* that was selected in the step 116*g*. In step 116*i*, the ice-filled bag 20*a* is then stacked at the disposal zone 126*a-j* that was selected in the step 116*g*. After the step 116*i*, in the step 116*j* the basket 98 is rotated back to its home rotate position shown in FIGS. 4, 5, 8 and 9. Before, during and/or after the step 116*j*, in step 116*k* the basket 98 is moved back to its movement home position shown in FIGS. 4, 5, 8 and 9. Before, during and/or after one or more of the steps 116*a-k*, the degree to which the region 21 of the merchandiser 19 is filled with the ice-filled bags 20 is determined in step 116*l*, with the determined degree being based on the respective measurements taken in the step 116*e*.

Figure 20:
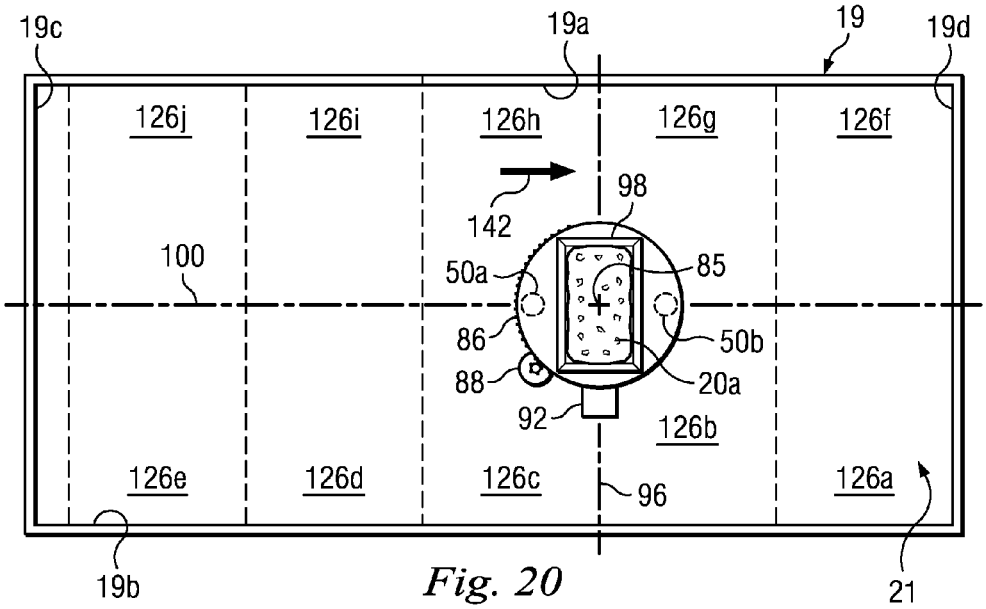
FIGS. 20-24 are diagrammatic illustrations of top plan views of respective portions of the merchandiser of FIGS. 1, 2, 4-6, 8 and 9 and the distribution and stacking system of FIGS. 2 and 4-9 during the execution of the step of FIG. 19, according to an exemplary embodiment.

In an exemplary embodiment, as illustrated in FIG. 20 with continuing reference to FIGS. 1-19, the step 116*a* is substantially similar to the step 110*a*, except that the ice-filled bag 20*a* is disposed in the basket 98 during the basket 98's movement along the axis 100, as indicated by an arrow 142 in FIG. 20. The basket 98 and thus the ice-filled bag 20*a* are moved to the right of the basket 98's movement home position shown in FIGS. 4, 5, 8 and 9 to ensure that the ice-filled bag 20*a* is separated from the remainder of the bags in the bagging system 36 before the basket 98 is rotated in the step 116*b*. In an exemplary embodiment, the basket 98 and thus the ice-filled bag 20*a* moves approximately two feet to the right. Since the step 116*a* is substantially similar to the step 110*a*, the step 116*a* will not be described in further detail.

Figure 21:
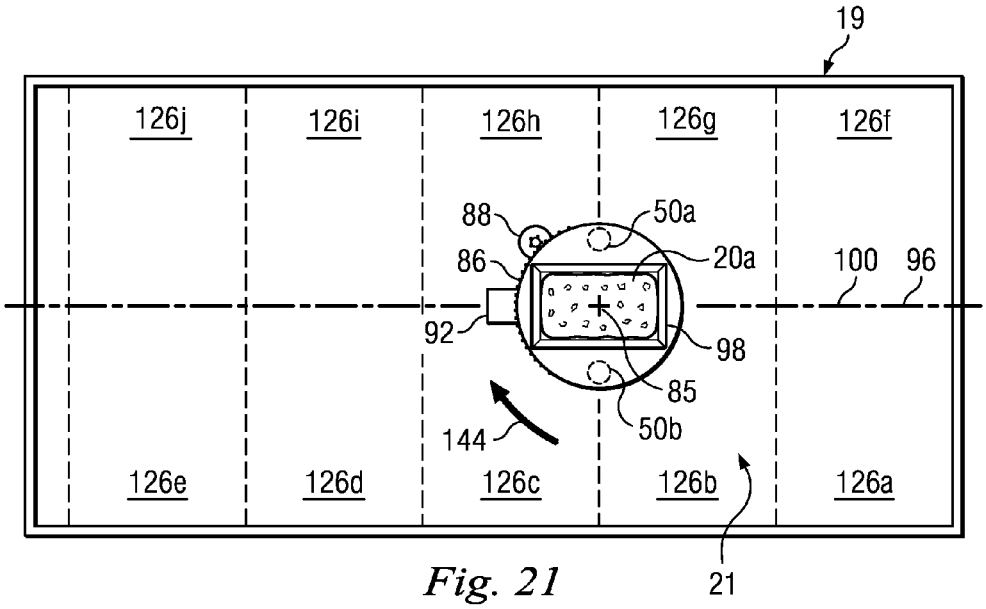

In an exemplary embodiment, as illustrated in FIG. 21 with continuing reference to FIGS. 1-20, the step 116*b* is substantially similar to the step 110*b*, except that the ice-filled bag 20*a* is disposed in the basket 98 during the basket 98's rotation about the axis 85, as indicated by an arrow 144 in FIG. 21. Since the step 116*b* is substantially similar to the step 110*b*, the step 116*b* will not be described in further detail.

Figure 22:
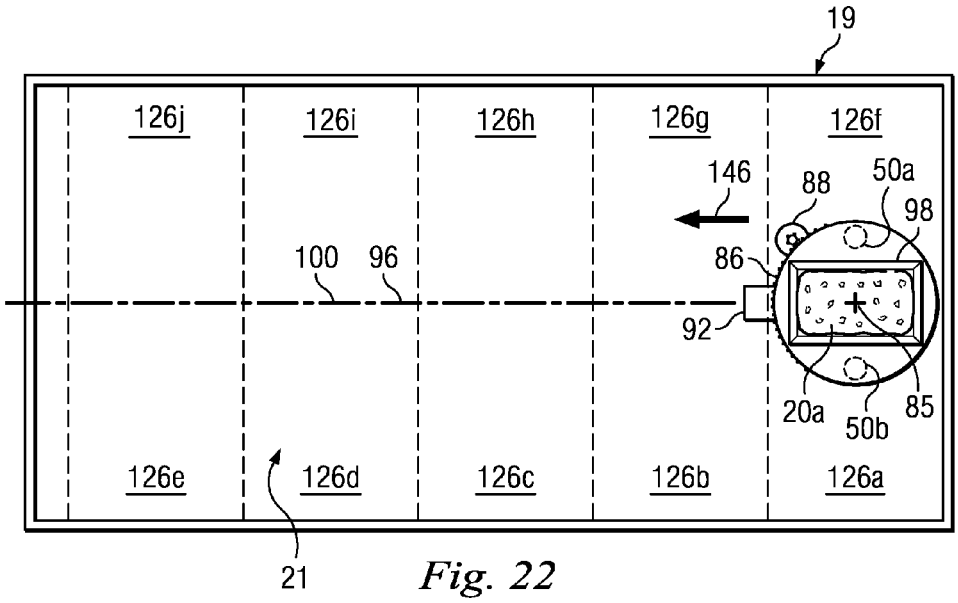

In an exemplary embodiment, as illustrated in FIGS. 21 and 22 with continuing reference to FIGS. 1-20, the step 116*c* is substantially similar to the step 110*c*, except that the ice-filled bag 20*a* is disposed in the basket 98 during the basket 98's movement along the axis 100. Since the step 116*c* is substantially similar to the step 110*c*, the step 116*c* will not be described in further detail.

Figure 23:
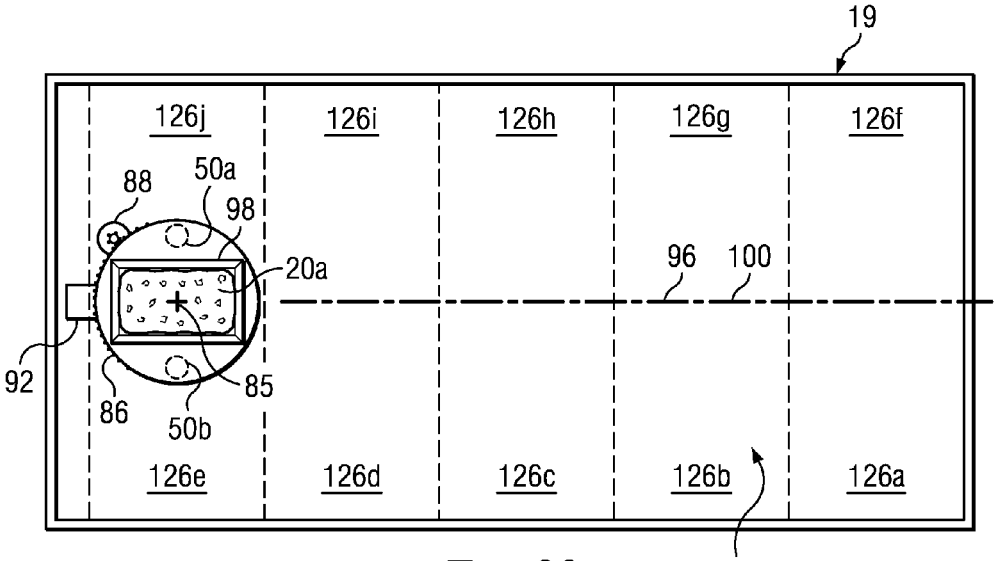

In an exemplary embodiment, as illustrated in FIGS. 22 and 23 with continuing reference to FIGS. 1-21, the step 116*d* is substantially similar to the step 110*d*, except that the ice-filled bag 20*a* is disposed in the basket 98 during the basket 98's movement along the axis 100, as indicated by an arrow 146 in FIG. 22. Since the step 116*d* is substantially similar to the step 110*d*, the step 116*d* will not be described in further detail.

In an exemplary embodiment, the step 116*e* is substantially similar to the step 110*e*, except that the ice-filled bag 20*a* is disposed in the basket 98 during the measuring of the respective stacking levels of the disposal zones 126*a-j*. Since the step 116*e* is substantially similar to the step 110*e*, the step 116*e* will not be described in further detail.

In an exemplary embodiment, to determine the lowest stacking level of the respective stacking levels of the disposal zones 126*a-j* in the step 116*f*, the respective stacking levels measured in the step 116*e* are compared to determine the lowest stacking level. In an exemplary embodiment, the respective stacking levels measured in the step 116*e* are compared in the step 116*f* using one or more of the sensors 50*a* and 50*b* and the computer 40 of the control system 38.

In an exemplary embodiment, to select one of the disposal zones 126*a-j* in the step 116*g*, the disposal zone(s) 126*a-j* having the lowest stacking level, as determined in the step 116*f*, is (or are) identified. If only one of the disposal zones 126*a-j* has the lowest stacking level as determined in the step 116*f*, then that one disposal zone 126*a-j* is selected in the step 116*g*. In an exemplary embodiment, if two of the disposal zones 126*a-j* have the lowest stacking level as determined in the step 116*f*, and one of the two disposal zones 126*a-j* is in the front row, that is, is one of the disposal zones 126*a-e*, and the other of the two disposal zones is in the back row, that is, is one of the disposal zones 126*f-j*, then the disposal zone in the front row is selected in the step 116*g*. In an exemplary embodiment, if two of the disposal zones 126*a-j* have the lowest stacking level, then the disposal zone 126*a-j* that is closer to the right end portion of the region 21 of the merchandiser 19, that is, closer to the wall 19*d*, is selected in the step 116*g*. In an exemplary embodiment, if more than one of the disposal zones 126*a-j* has the lowest stacking level as determined in the step 116*f*, then the rightmost disposal zone on the front row (i.e., in the disposal zones 126*a-e*), if any, is selected in the step 116*g*; otherwise the rightmost disposal zone in the back row (i.e., in the disposal zones 126*f-j*) is selected in the step 116*g*. In an exemplary embodiment, if more than one of the disposal zones 126*a-j* has the lowest stacking level as determined in the step 116*f*, then the rightmost disposal zone is selected in the step 116*g*, regardless of which row the disposal zone is in.

In an exemplary embodiment, the stacking level of the one of the disposal zones 126*a-j* selected in the step 116*g* is generally equal to the lowest stacking level determined in the step 116*f*. In an exemplary embodiment, the stacking level of the disposal zone 126*a-j* selected in the step 116*g* is equal to or lower than the respective stacking levels of the other disposal zones 126*a-j*. In an exemplary embodiment, the quantity of the ice-filled bags 20 stacked in the one of the disposal zones 126*a-j* selected in the step 116*g* is equal to or lower than the respective quantities of the ice-filled bags 20 stacked in the other disposal zones 126*a-j*. In an exemplary embodiment, the column height of the ice-filled bags 20 in the disposal zone 126*a-j* selected in the step 116*g* is equal to or lower than the respective column heights of the ice-filled bags 20 stacked in the other disposal zones 126*a-j*.

Figure 24:
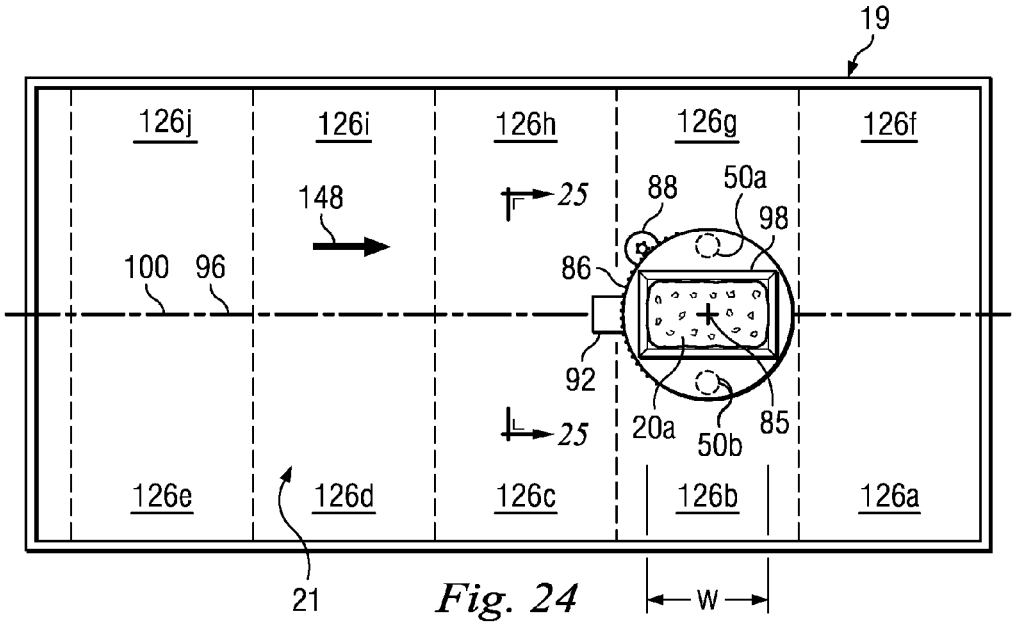

In an exemplary embodiment, as illustrated in FIG. 24 with continuing reference to FIGS. 1-23, to move the basket 98 and thus the ice-filled bag 20*a* to the selected disposal zone in the step 116*h*, the drive motor 74 drives the gear 74*c* counterclockwise as viewed in FIG. 5. As a result, the belt 76 is driven, causing the gear 66—and thus the shaft 60 and the gears 64 and 68—to rotate counterclockwise as viewed in FIG. 5, thereby driving the belts 78 and 80. During the driving of the belts 78 and 80, the gears 70 and 72 and thus the shaft 62 also rotate counterclockwise as viewed in FIG. 5. As a result, the carriage 81, and thus the basket 98 and the ice-filled bag 20*a* disposed therein, move to the right along the axis 100, as indicated by an arrow 148 in FIG. 24. The carriage 81, and thus the basket 98 and the ice-filled bag 20*a* disposed therein, are moved along the axis 100 to a position that is generally aligned, along the axis 100, with the one of the disposal zones 126*a-j* selected in the step 116*g*. As shown in FIG. 24, the ice-filled bag 20*a* defines a width w, which extends along the axis 96 when the ice-filled bag 20*a* is disposed in the basket 98. The ice-filled bag 20*a* further defines a length l (shown in FIGS. 25*b* and 25*c*), which is longer than, and perpendicular to, the width w, and which also generally extends along the axis 85 when the ice-filled bag 20*a* is disposed in the basket 98.

For example, as shown in FIG. 24, the disposal zone 126*b* is the one of the disposal zones 126*a-j* selected in the step 116*g*. Thus, in the step 116*h*, the carriage 81, and thus the basket 98 and the ice-filled bag 20*a* disposed therein, move along the axis 100 to a position that is generally aligned with the disposal zone 126*b* along the axis 100.

In an exemplary embodiment, if the one of the disposal zones 126*a-j* selected in the step 116*g* is either the disposal zone 126*e* or the disposal zone 126*j*, the step 116*h* may be omitted, or the basket 98 and thus the ice-filled bag 20*a* disposed therein may move slightly to the right or left, as viewed in FIG. 24.

Figure 25A:
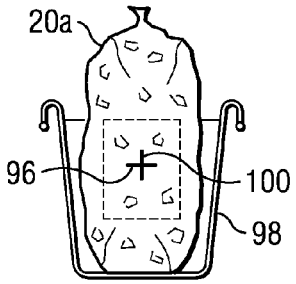
FIGS. 25*a*, 25*b* and 25*c* are diagrammatic illustrations of section views of respective portions of the merchandiser of FIGS. 1, 2, 4-6, 8 and 9 and the distribution and stacking system of FIGS. 2 and 4-9 taken along line 25-25 of FIG. 24 during the execution of the step of FIG. 19, according to an exemplary embodiment.
Figure 25B:
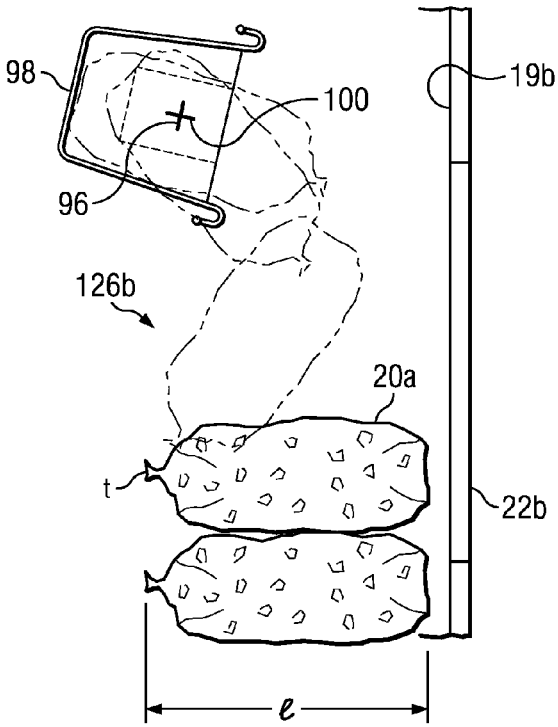
Figure 25C:
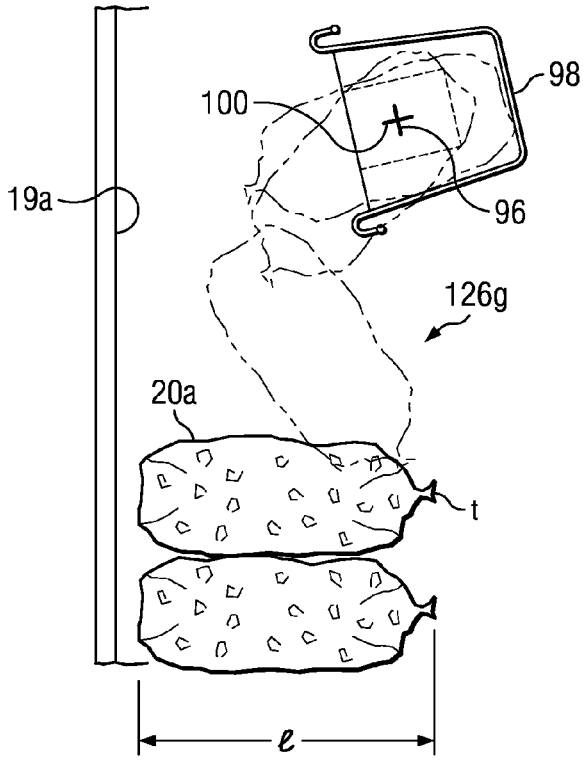

In an exemplary embodiment, as illustrated in FIGS. 25*a*, 25*b* and 25*c* with continuing reference to FIGS. 1-24, to stack the ice-filled bag 20*a* in the selected disposal zone 126*b* in the step 116*i*, the kicker motor 92 drives the output shaft 92*a*, causing the basket 98 to rotate about the axis 96 in a clockwise direction, as viewed in FIGS. 25*a* and 25*b*. As a result, the ice-filled bag 20*a* is discharged from the basket 98 and falls either onto the bottom wall 19*f* of the merchandiser 19 in the selected disposal zone 126*b*, or on top of another of the ice-filled bags 20 in the selected disposal zone 126*b*. As shown in FIGS. 25*a* and 25*b*, the ice-filled bag 20*a* defines the length l. In an exemplary embodiment, when the output shaft 92*a* is driven, the shaft 94 is stationary and the shaft 92*a* and thus the basket 98 rotate relative to the shaft 94 and the bracket 102. In an exemplary embodiment, when the output shaft 92 is driven, the shaft 94 rotates, relative to the bracket 102 and along with the shaft 92 and the basket 98.

As shown in FIG. 25*b*, as a result of the disposal of the ice-filled bag 20*a* in the selected disposal zone 126*g*, the ice-filled bag 20*a* is positioned so that the length l is generally perpendicular to each of the doors 22*a* and 22*b* when the doors 22*a* and 22*b* are in their respective closed positions. The length l of the ice-filled bag 20*a* is also generally perpendicular to each of the walls 19*a* and 19*b* of the merchandiser 19, thus extending in a front-to-back direction. The width w of the ice-filled bag 20*a* is generally parallel to each of the doors 22*a* and 22*b* when the doors 22*a* and 22*b* are in their respective closed positions. The width w of the ice-filled bag 20*a* is generally parallel to each of the walls 19*a* and 19*b* of the merchandiser 19. The top t of the ice-filled bag 20*a* is positioned opposite the wall 19*b* so that the top t is positioned about midway between the walls 19*a* and 19*b*. Since the length l of the ice-filled bag 20*a* is already perpendicular to each of the doors 22*a* and 22*b* as a result of the discharge of the ice-filled bag 20*a* from the basket 98, the need for personnel to open the doors 22*a* and 22*b* and stack the ice-filled bags 20 in a front-to-back direction within the region 21 is eliminated.

As shown in FIG. 25*c*, if the selected disposal zone is the disposal zone 126*g*, rather than the disposal zone 126*b*, the kicker motor 92 drives the output shaft 92*a*, causing the basket 98 to rotate about the axis 96 in a counterclockwise direction, as viewed in FIG. 25*c*. As a result, the ice-filled bag 20*a* is discharged from the basket 98 and falls either onto the bottom wall 19*f* of the merchandiser 19 in the selected disposal zone 126*g*, or on top of another of the ice-filled bags 20 in the selected disposal zone 126*g*. As shown in FIG. 25*c*, as a result of the disposal of the ice-filled bag 20*a* in the selected disposal zone 126*g*, the ice-filled bag 20*a* is positioned so that the length l is generally perpendicular to each of the doors 22*a* and 22*b* when the doors 22*a* and 22*b* are in their respective closed positions. The length l of the ice-filled bag 20*a* is also generally perpendicular to the each of the walls 19*a* and 19*b* of the merchandiser 19. The width w of the ice-filled bag 20*a* is generally parallel to each of the doors 22*a* and 22*b* when the doors 22*a* and 22*b* are in their respective closed positions. The width w of the ice-filled bag 20*a* is generally parallel to each of the walls 19*a* and 19*b* of the merchandiser 19. The top t of the ice-filled bag 20*a* is positioned opposite the wall 19*a* so that the top t is positioned about midway between the walls 19*a* and 19*b*. Since the length l of the ice-filled bag 20*a* is perpendicular to each of the doors 22*a* and 22*b* as a result of the discharge of the ice-filled bag 20*a* from the basket 98, the need for personnel to open the doors 22*a* and 22*b* and stack the ice-filled bags 20 in a front-to-back direction within the region 21 is eliminated, regardless of whether the ice-filled bags 20 are disposed in the front row of the region 21 (the disposal zones 126*a-e*) or the back row of the region 21 (the disposal zones 126*f-j*).

Before the rotation of the basket 98 in the step 116*b* (see, e.g., FIG. 20), when the ice-filled bag 20*a* is initially disposed in the basket 98, and when the doors 22*a* and 22*b* are in their respective closed positions, the width w of the ice-filled bag 20*a* is generally perpendicular to each of the doors 22*a* and 22*b*, and the length l of the ice-filled bag 20*a* is generally parallel to each of the doors 22*a* and 22*b*.

In an exemplary embodiment, the step 116*j* is substantially similar to the step 110*g* and therefore the step 116*j* will not be described in detail.

In an exemplary embodiment, the step 116*k* is substantially similar to the step 110*h* and therefore the step 116*k* will be not be described in detail.

In an exemplary embodiment, to determine the degree to which the region 21 of the merchandiser 19 is filled with the ice-filled bags 20*a* in the step 116*l*, the percentage of the predetermined volume of the region 21 that is filled with the ice-filled bags 20 is calculated based on the measurements taken in the step 116*e*. In an exemplary embodiment, this calculation is carried out, at least in part, by one or more of the computer 40 and the sensors 50*a* and 50*b*. In an exemplary embodiment, the predetermined volume of the region 21 is the total volume of space within the region 21 in which the ice-filled bags 20 may be disposed. In an exemplary embodiment, the degree determined in the step 116*l* takes into account the disposal of the ice-filled bag 20*a* in the selected disposal zone 126*a-j* by, for example, calculating the percentage of the predetermined volume of the region 21 that is filled with the ice-filled bags 20 based on the measurements taken in the step 116*e*, and then subtracting the percentage of the predetermined volume of the region 21 that has been, or is expected to be, taken up by the ice-filled bag 20*a* after it is disposed in the region 21.

As noted above, after the ice-filled bag 20*a* has been distributed and stacked in the step 116, it is determined in the step 118 whether the region 21 of the merchandiser 19 is full of the ice-filled bags 20. In an exemplary embodiment, to so make the determination in the step 118, it is determined whether the degree to which the region 21 is filled with the ice-filled bags 20 is equal to or greater than a predetermined percentage. The degree determined in the step 116*l* is compared with the predetermined percentage in the step 118 to determine whether the degree determined in the step 116*f* is equal to or greater than the predetermined percentage. If so, then it is determined in the step 118 that the region 21 is full of the ice-filled bags 20. If not, then it is determined in the step 118 that the region 21 is not full of the ice-filled bags 20. In an exemplary embodiment, the predetermined percentage is 98%. In an exemplary embodiment, the predetermined percentage is 50% or some other percentage.

As noted above, if it is determined that the region 21 is not full of the ice-filled bags 20, then another bag is filled with ice to thereby produce another of the ice-filled bags 20 in the step 120. The step 120 is substantially similar to the step 114 and therefore will not be described in further detail. As further noted above, after being produced in the step 120, the other ice-filled bag 20 is stacked and distributed in the step 122. The step 122 is substantially similar to the step 116 and therefore will not be described in further detail. As still further noted above, the steps 118, 120 and 122 are repeated until it is determined in the step 118 that the region 21 is full of the ice-filled bags 20.

In an exemplary embodiment, before, during and/or after the above-described operation of the apparatus 10 and/or the execution of the method 108, a request to determine the degree to which the region 21 of the merchandiser 19 is filled with the ice-filled bags 20 is transmitted from one of the remote user devices 30*a* and 30*b* to the computer 40 via the server 26, the network 28 and the communication module 46. In response, in an exemplary embodiment, the step 110 is executed, in accordance with the foregoing, to determine the degree to which the region 21 is filled with the ice-filled bags 20. Alternatively, in an exemplary embodiment, in response to the transmitted request, at least the steps 116*d*, 116*e* and 116*l* of the step 116 are executed, in accordance with the foregoing, to determine the degree to which the region 21 is filled with the ice-filled bags 20. In an exemplary embodiment, after the degree to which the region 21 is filled with the ice-filled bags 20 is determined in response to the transmitted request, data corresponding to the degree is transmitted from the computer 40 to the one or more remote user devices 30*a* and 30*b* via the communication module 46, the server 26 and the network 28. Thus, using the remote user device 30*a* or 30*b*, an operator of the apparatus 10 can determine how full the merchandiser 19 is from a location that is remote from the installation location of the apparatus 10.

In an exemplary embodiment, before, during and/or after the above-described operation of the apparatus 10 and/or the execution of the method 108, it is determined whether the degree to which the region 21 of the merchandiser 19 (as determined in either the step 110 or the step 116*l*) is less than a relatively low predetermined percentage, thus indicating that the supply of the ice-filled bags 20 in the merchandiser 19 is relatively low because, for example, the apparatus 10 may not be producing the ice-filled bags 20 fast enough to keep up with customer demand. In an exemplary embodiment, such a relatively low predetermined percentage may be 50%, 25%, 10%, etc. In an exemplary embodiment, this relatively low determination is made in two instances in the method 108, namely after the step 112 but before the step 114, and also after the step 118 but before the step 120. In an exemplary embodiment, if it is determined that the degree to which the region 21 of the merchandiser 19 is less than the relatively low predetermined percentage, then before, during or after the step 114 or 120, data corresponding to the degree is transmitted from the computer 40 to one or more of the remote user devices 30*a* and 30*b* via the communication module 46, the server 26 and the network 28. Thus, using the remote user device 30*a* or 30*b*, an operator of the apparatus 10 can be alerted at a remote location that the supply of the ice-filled bags 20 in the merchandiser 19 is relatively low.

In an exemplary embodiment, during at least any of the steps 110*a*, 110*c*, 110*d*, 116*a*, 116*c* and 116*d*, if the basket 98 encounters an obstruction during its movement along the axis 100 within the merchandiser 19, then the basket 98 stops moving. The location of the obstruction is considered to be the left end portion of the region 21 of the merchandiser 19 if the basket 98 was moving to the left when the basket 98 stopped moving. The location of the obstruction is considered to be the right end portion of the region 21 of the merchandiser 19 if the basket 98 was moving to the right when the basket 98 stopped moving. The remaining steps of the step 110 or 116, and the remaining steps of the method 108, are then executed with a subset of the disposal zones 126*a-j*, that is, those disposal zones 126*a-j* that the basket 98 can still be positioned above to measure the respective stacking levels and to discharge the ice-filled bags 20, notwithstanding the presence of the obstruction within the region 21 of the merchandiser 19.

In an exemplary embodiment, during the operation of the apparatus 10 and/or the execution of the method 108, if the sensor 23*a* determines that the door 22*b* is in an open position, then the operation of the apparatus 10 and/or the execution of the method 108 are temporarily ceased by, for example, stopping the supply of electrical power to at least the distribution and stacking system 37. The operation of the apparatus 10 and/or the execution of the method 108 is then re-started after the sensor 23*a* determines that the door 22*a* is in its closed position. Similarly, if the sensor 23*b* determines that the door 22*b* is in an open position, then the operation of the apparatus 10 and/or the execution of the method 108 are temporarily ceased by, for example, stopping the supply of electrical power to at least the distribution and stacking system 37. The operation of the apparatus 10 and/or the execution of the method 108 are then re-started after the sensor 23*b* determines that the door 22*b* is in its closed position.

In an exemplary embodiment, at least one other apparatus substantially similar to the apparatus 10 and located at the same or another location may be operably coupled to the server 26 via the network 28. In an exemplary embodiment, a plurality of apparatuses substantially similar to the apparatus 10 and located at the same and/or different locations may be operably coupled to the server 26 via the network 28. In several exemplary embodiments, the computer readable medium of the server 26, and the contents stored therein, may be distributed throughout the system 24. In an exemplary embodiment, the computer readable medium of the server 26 and the contents stored therein may be distributed across a plurality of apparatuses such as, for example, the apparatus 10 and/or one or more other apparatuses substantially similar to the apparatus 10. In an exemplary embodiment, the server 26 may include one or more host computers, the computer 40 of the apparatus 10, and/or one or more computers in one or more other apparatuses that are substantially similar to the apparatus 10.

In an exemplary embodiment, the apparatus 10 may be characterized as a thick client. In an exemplary embodiment, the apparatus 10 may be characterized as a thin client, and therefore the functions and/or uses of the computer 40 including the processor 42 and/or the memory 44 may instead be functions and/or uses of the server 26. In several exemplary embodiments, the apparatus 10 may function as both a thin client and a thick client, with the degree to which the apparatus 10 functions as a thin client and/or a thick client being dependent upon a variety of factors including, but not limited to, the instructions stored in the memory 44 for execution by the processor 42.

Figure 26:
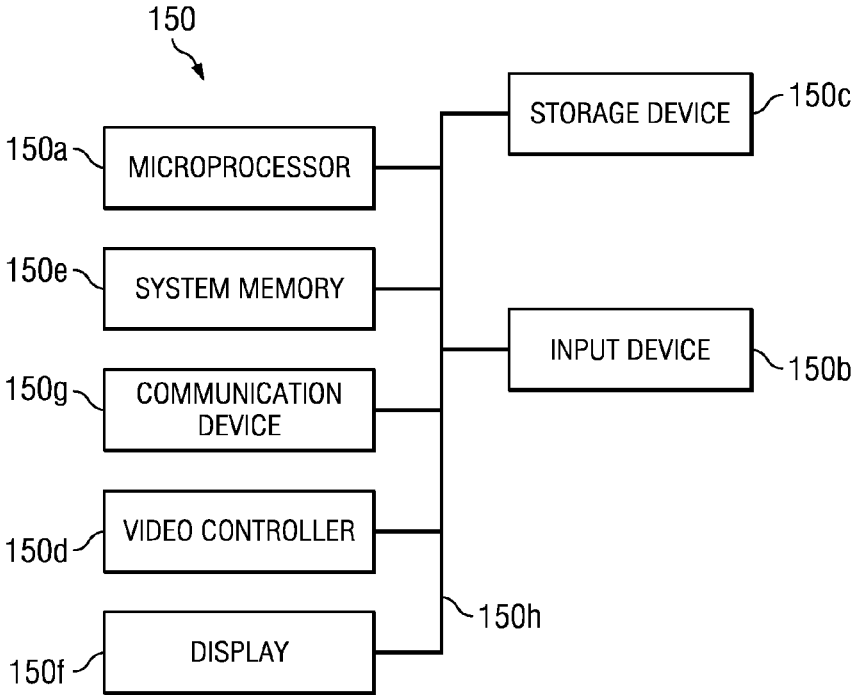
FIG. 26 is a diagrammatic illustration of a node for implementing one or more exemplary embodiments of the present disclosure, according to an exemplary embodiment.

In an exemplary embodiment, as illustrated in FIG. 26 with continuing reference to FIGS. 1-25*c*, an illustrative node 150 for implementing one or more embodiments of one or more of the above-described networks, elements, methods and/or steps, and/or any combination thereof, is depicted. The node 150 includes a microprocessor 150*a*, an input device 150*b*, a storage device 150*c*, a video controller 150*d*, a system memory 150*e*, a display 150*f*, and a communication device 150*g* all interconnected by one or more buses 150*h*. In several exemplary embodiments, the storage device 150*c* may include a floppy drive, hard drive, CD-ROM, optical drive, any other form of storage device and/or any combination thereof. In several exemplary embodiments, the storage device 150*c* may include, and/or be capable of receiving, a floppy disk, CD-ROM, DVD-ROM, or any other form of computer-readable medium that may contain executable instructions. In several exemplary embodiments, the communication device 150*g* may include a modem, network card, or any other device to enable the node to communicate with other nodes. In several exemplary embodiments, any node represents a plurality of interconnected (whether by intranet or Internet) computer systems, including without limitation, personal computers, mainframes, PDAs, and cell phones.

In several exemplary embodiments, one or more of the central server 26, the network 28, the remote user devices 30*a* and 30*b*, the control system 38, the computer 40, the control panel 18, the communication module 46, the sensors 23*a*, 23*b*, 48*a*, 48*b*, 48*c*, 48*d*, 50*a*, 50*b*, 52 and 54, any other of the above-described sensors, and/or any of the above-described motors is, or at least includes, the node 150 and/or components thereof, and/or one or more nodes that are substantially similar to the node 150 and/or components thereof.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, personal digital assistants (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a node such as, for example, on a client machine or server.

In several exemplary embodiments, combinations of software and hardware could also be used for providing enhanced functionality and performance for certain embodiments of the present disclosure. In an exemplary embodiment, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In an exemplary embodiment, a data structure may provide an organization of data, or an organization of executable code. In several exemplary embodiments, data signals could be carried across transmission mediums and store and transport various data structures, and, thus, may be used to transport an embodiment of the present disclosure.

In several exemplary embodiments, the network 28, and/or one or more portions thereof, may be designed to work on any specific architecture. In an exemplary embodiment, one or more portions of the network 28 may be executed on a single computer, local area networks, client-server networks, wide area networks, internets, hand-held and other portable and wireless devices and networks.

In several exemplary embodiments, a database may be any standard or proprietary database software, such as Oracle, Microsoft Access, SyBase, or DBase II, for example. In several exemplary embodiments, the database may have fields, records, data, and other database elements that may be associated through database specific software. In several exemplary embodiments, data may be mapped. In several exemplary embodiments, mapping is the process of associating one data entry with another data entry. In an exemplary embodiment, the data contained in the location of a character file can be mapped to a field in a second table. In several exemplary embodiments, the physical location of the database is not limiting, and the database may be distributed. In an exemplary embodiment, the database may exist remotely from the server, and run on a separate platform. In an exemplary embodiment, the database may be accessible across the Internet. In several exemplary embodiments, more than one database may be implemented.

In an exemplary embodiment, the memory 44 of the control system 38 includes a plurality of instructions stored therein, the instructions being executable by at least the processor 42 to execute and control the above-described operation of the apparatus 10 and the system 24. In an exemplary embodiment, the memory 44 of the control system 38 includes a plurality of instructions stored therein, the instructions being executable by at least the processor 42 to execute the method 108.

In several exemplary embodiments, while different steps, processes, and procedures are described as appearing as distinct acts, one or more of the steps, one or more of the processes, and/or one or more of the procedures could also be performed in different orders, simultaneously and/or sequentially. In several exemplary embodiments, the steps, processes and/or procedures could be merged into one or more steps, processes and/or procedures.

A method has been described that includes providing a temperature-controlled storage unit, the temperature-controlled storage unit defining a region, the region including a plurality of disposal zones, each disposal zone defining a stacking level; selecting a disposal zone from the plurality of disposal zones, wherein the stacking level of the selected disposal zone is equal to or lower than the respective stacking levels of the other disposal zones in the plurality of disposal zones; and disposing an ice-filled bag in the selected disposal zone. In an exemplary embodiment, selecting the disposal zone from the plurality of disposal zones includes determining the stacking level of each of the disposal zones in the plurality of disposal zones; and determining the lowest stacking level of the respective stacking levels of the disposal zones in the plurality of disposal zones, wherein the lowest stacking level is generally equal to the stacking level of the selected disposal zone. In an exemplary embodiment, determining the stacking level of each of the disposal zones in the plurality of disposal zones includes measuring the respective stacking level of each of the disposal zones using at least one sensor. In an exemplary embodiment, measuring the respective stacking level of each of the disposal zones using the at least one sensor includes moving the at least one sensor across the disposal zone while the at least one sensor is positioned above the disposal zone; and taking a plurality of stacking level measurements using the at least one sensor during moving the at least one sensor across the disposal zone. In an exemplary embodiment, the method includes before disposing the ice-filled bag in the selected disposal zone, filling a bag with a measured amount of ice to thereby produce the ice-filled bag, including at least partially disposing the bag in a basket; and filling the bag with the measured amount of ice while the bag is at least partially disposed in the basket; wherein disposing the ice-filled bag in the selected disposal zone includes moving the basket, and thus the ice-filled bag, along a first axis to a position that is generally aligned with the selected disposal zone along the first axis; and rotating the basket about a second axis to thereby discharge the ice-filled bag from the basket and dispose the ice-filled bag in the selected disposal zone, the second axis being coaxial with, or generally parallel to, the first axis. In an exemplary embodiment, the temperature-controlled storage unit includes at least one door movable between an open position in which access to the region is permitted, and a closed position; wherein the ice-filled bag has a length and a width; and wherein, in response to the rotation of the basket about the second axis and the resulting disposal of the ice-filled bag in the selected disposal zone, the ice-filled bag is positioned so that the length of the ice-filled bag is generally perpendicular to the door when the door is in the closed position. In an exemplary embodiment, the method includes rotating the basket, and thus the ice-filled bag, about a third axis that is generally perpendicular to each of the first and second axes, wherein the basket is rotated about the third axis after the bag is filled with ice but before the basket is rotated about the second axis. In an exemplary embodiment, the method includes determining whether the region is full of ice-filled bags; and if the region is not full of ice-filled bags, then selecting another disposal zone from the plurality of disposal zones, wherein the stacking level of the another selected disposal zone is equal to or lower than the respective stacking levels of the other disposal zones in the plurality of disposal zones; and disposing another ice-filled bag in the another selected disposal zone. In an exemplary embodiment, determining whether the region is full of ice-filled bags includes determining the degree to which the region is filled with ice-filled bags; and determining whether the degree to which the region is filled with ice-filled bags is equal to or greater than a predetermined percentage. In an exemplary embodiment, the method includes determining the degree to which the region is filled with ice-filled bags. In an exemplary embodiment, the degree to which the region is filled with ice-filled bags is determined using at least a computer, the computer being operably coupled to the temperature-controlled storage unit; and wherein the method further includes transmitting data from the computer to a remote user device via a network, the data corresponding to the degree to which the region is filled with ice-filled bags, wherein the remote user device is positioned at a location that is remote from the temperature-controlled storage unit. In an exemplary embodiment, the method includes transmitting from the remote user device to the computer via the network a request to determine the degree to which the region is filled with ice-filled bags; wherein the degree to which the region is filled with ice-filled bags is determined in response to the transmitted request. In an exemplary embodiment, determining the degree to which the region is filled with ice-filled bags includes measuring the respective stacking level of each of the disposal zones, including moving at least one sensor across the disposal zone while the at least one sensor is positioned above the disposal zone; and taking a plurality of stacking level measurements using the at least one sensor during moving the at least one sensor across the disposal zone. In an exemplary embodiment, the storage unit includes front and back inside walls spaced in a parallel relation; wherein the ice-filled bag has a length and a width; and wherein, in response to disposing the ice-filled bag in the selected disposal zone, the ice-filled bag is positioned in the selected disposal zone so that: the length is generally perpendicular to each of the front and back inside walls; and the width is generally parallel to each of the front and back inside walls.

A method has been described that includes providing a basket and an ice-filled bag initially disposed therein; providing a temperature-controlled storage unit, the temperature-controlled storage unit defining a region, the region including a plurality of disposal zones; and disposing the ice-filled bag in one of the disposal zones, including rotating the basket, and thus the ice-filled bag disposed therein, about a first axis; moving the basket, and thus the ice-filled bag disposed therein, along a second axis to a position that is generally aligned with the one disposal zone along the second axis, the second axis being generally perpendicular to the first axis; and rotating the basket about a third axis, the third axis being generally perpendicular to the first axis and coaxial with, or generally parallel to, the second axis; wherein, in response to the rotation of the basket about the third axis, the ice-filled bag is discharged from the basket and disposed in the one of the disposal zones. In an exemplary embodiment, the temperature-controlled storage unit includes at least one door movable between an open position in which access to the region is permitted, and a closed position; wherein the ice-filled bag has a length and a width; and wherein, in response to the rotation of the basket about the third axis and the resulting disposal of the ice-filled bag in the one of the disposal zones, the ice-filled bag is positioned so that the width of the ice-filled bag is generally parallel to the door when the door is in the closed position, and the length of the ice-filled bag is generally perpendicular to the door when the door is in the closed position. In an exemplary embodiment, when the ice-filled bag is initially disposed in the basket: the width of the ice-filled bag is generally perpendicular to the door when the door is in the closed position, and the length of the ice-filled bag is generally parallel to the door when the door is in the closed position; and wherein, in response to the rotation of the basket, and thus the ice-filled bag disposed therein, about the first axis: the width of the ice-filled bag is generally parallel to the door when the door is in the closed position; and the length of the ice-filled bag is generally parallel to the door when the door is in the closed position. In an exemplary embodiment, each of the disposal zones defines a stacking level; and wherein the method further includes selecting the one of the disposal zones, including determining the stacking level of each of the disposal zones in the plurality of disposal zones; and determining the lowest stacking level of the respective stacking levels of the disposal zones in the plurality of disposal zones, wherein the lowest stacking level is generally equal to the stacking level of the one of the disposal zones.

A method has been described that includes providing a temperature-controlled storage unit in which a plurality of ice-filled bags are adapted to be stored, the temperature-controlled storage unit defining a region, the region including a plurality of disposal zones, each disposal zone defining a stacking level; and determining the degree to which the region is filled with the ice-filled bags, including measuring the respective stacking level of each of the disposal zones. In an exemplary embodiment, measuring the respective stacking level of each of the disposal zones includes measuring the respective stacking level of each of the disposal zones using at least one sensor. In an exemplary embodiment, measuring the respective stacking level of each of the disposal zones using the at least one sensor includes moving the at least one sensor across the disposal zone while the at least one sensor is positioned above the disposal zone; and taking a plurality of stacking level measurements using the at least one sensor during moving the at least one sensor across the disposal zone. In an exemplary embodiment, the method includes determining whether the region is full of ice-filled bags, including determining whether the degree to which the region is filled with ice-filled bags is equal to or greater than a predetermined percentage. In an exemplary embodiment, the degree to which the region is filled with ice-filled bags is determined using at least a computer, the computer being operably coupled to the temperature-controlled storage unit; and wherein the method further includes transmitting data from the computer to a remote user device via a network, the data corresponding to the degree to which the region is filled with ice-filled bags, wherein the remote user device is positioned at a location that is remote from the temperature-controlled storage unit. In an exemplary embodiment, the method includes transmitting from the remote user device to the computer via the network a request to determine the degree to which the region is filled with ice-filled bags; wherein the degree to which the region is filled with ice-filled bags is determined in response to the transmitted request.

A system has been described that includes a temperature-controlled storage unit, the temperature-controlled storage unit defining a region, the region including a plurality of disposal zones, each disposal zone defining a stacking level; means for selecting a disposal zone from the plurality of disposal zones, wherein the stacking level of the selected disposal zone is equal to or lower than the respective stacking levels of the other disposal zones in the plurality of disposal zones; and means for disposing an ice-filled bag in the selected disposal zone. In an exemplary embodiment, means for selecting the disposal zone from the plurality of disposal zones includes means for determining the stacking level of each of the disposal zones in the plurality of disposal zones; and means for determining the lowest stacking level of the respective stacking levels of the disposal zones in the plurality of disposal zones, wherein the lowest stacking level is generally equal to the stacking level of the selected disposal zone. In an exemplary embodiment, means for determining the stacking level of each of the disposal zones in the plurality of disposal zones includes means for measuring the respective stacking level of each of the disposal zones using at least one sensor. In an exemplary embodiment, means for measuring the respective stacking level of each of the disposal zones using the at least one sensor includes means for moving the at least one sensor across the disposal zone while the at least one sensor is positioned above the disposal zone; and means for taking a plurality of stacking level measurements using the at least one sensor during moving the at least one sensor across the disposal zone. In an exemplary embodiment, the system includes means for before disposing the ice-filled bag in the selected disposal zone, filling a bag with a measured amount of ice to thereby produce the ice-filled bag, including means for at least partially disposing the bag in a basket; and means for filling the bag with the measured amount of ice while the bag is at least partially disposed in the basket; wherein means for disposing the ice-filled bag in the selected disposal zone includes means for moving the basket, and thus the ice-filled bag, along a first axis to a position that is generally aligned with the selected disposal zone along the first axis; and means for rotating the basket about a second axis to thereby discharge the ice-filled bag from the basket and dispose the ice-filled bag in the selected disposal zone, the second axis being coaxial with, or generally parallel to, the first axis. In an exemplary embodiment, the temperature-controlled storage unit includes at least one door movable between an open position in which access to the region is permitted, and a closed position; wherein the ice-filled bag has a length and a width; and wherein, in response to the rotation of the basket about the second axis and the resulting disposal of the ice-filled bag in the selected disposal zone, the ice-filled bag is positioned so that the length of the ice-filled bag is generally perpendicular to the door when the door is in the closed position. In an exemplary embodiment, the system includes means for rotating the basket, and thus the ice-filled bag, about a third axis that is generally perpendicular to each of the first and second axes, wherein the basket is rotated about the third axis after the bag is filled with ice but before the basket is rotated about the second axis. In an exemplary embodiment, the system includes means for determining whether the region is full of ice-filled bags; and means for if the region is not full of ice-filled bags, then selecting another disposal zone from the plurality of disposal zones, wherein the stacking level of the another selected disposal zone is equal to or lower than the respective stacking levels of the other disposal zones in the plurality of disposal zones; and disposing another ice-filled bag in the another selected disposal zone. In an exemplary embodiment, means for determining whether the region is full of ice-filled bags includes means for determining the degree to which the region is filled with ice-filled bags; and means for determining whether the degree to which the region is filled with ice-filled bags is equal to or greater than a predetermined percentage. In an exemplary embodiment, the system includes means for determining the degree to which the region is filled with ice-filled bags. In an exemplary embodiment, the degree to which the region is filled with ice-filled bags is determined using at least a computer, the computer being operably coupled to the temperature-controlled storage unit; and wherein the system further includes means for transmitting data from the computer to a remote user device via a network, the data corresponding to the degree to which the region is filled with ice-filled bags, wherein the remote user device is positioned at a location that is remote from the temperature-controlled storage unit. In an exemplary embodiment, the system includes means for transmitting from the remote user device to the computer via the network a request to determine the degree to which the region is filled with ice-filled bags; wherein the degree to which the region is filled with ice-filled bags is determined in response to the transmitted request. In an exemplary embodiment, means for determining the degree to which the region is filled with ice-filled bags includes means for measuring the respective stacking level of each of the disposal zones, including means for moving at least one sensor across the disposal zone while the at least one sensor is positioned above the disposal zone; and means for taking a plurality of stacking level measurements using the at least one sensor during moving the at least one sensor across the disposal zone. In an exemplary embodiment, the storage unit includes front and back inside walls spaced in a parallel relation; wherein the ice-filled bag has a length and a width; and wherein, in response to disposing the ice-filled bag in the selected disposal zone, the ice-filled bag is positioned in the selected disposal zone so that: the length is generally perpendicular to each of the front and back inside walls; and the width is generally parallel to each of the front and back inside walls.

A system has been described that includes a basket and an ice-filled bag initially disposed therein; a temperature-controlled storage unit, the temperature-controlled storage unit defining a region, the region including a plurality of disposal zones; and means for disposing the ice-filled bag in one of the disposal zones, including means for rotating the basket, and thus the ice-filled bag disposed therein, about a first axis; means for moving the basket, and thus the ice-filled bag disposed therein, along a second axis to a position that is generally aligned with the one disposal zone along the second axis, the second axis being generally perpendicular to the first axis; and means for rotating the basket about a third axis, the third axis being generally perpendicular to the first axis and coaxial with, or generally parallel to, the second axis; wherein, in response to the rotation of the basket about the third axis, the ice-filled bag is discharged from the basket and disposed in the one of the disposal zones. In an exemplary embodiment, the temperature-controlled storage unit includes at least one door movable between an open position in which access to the region is permitted, and a closed position; wherein the ice-filled bag has a length and a width; and wherein, in response to the rotation of the basket about the third axis and the resulting disposal of the ice-filled bag in the one of the disposal zones, the ice-filled bag is positioned so that: the width of the ice-filled bag is generally parallel to the door when the door is in the closed position, and the length of the ice-filled bag is generally perpendicular to the door when the door is in the closed position. In an exemplary embodiment, when the ice-filled bag is initially disposed in the basket: the width of the ice-filled bag is generally perpendicular to the door when the door is in the closed position, and the length of the ice-filled bag is generally parallel to the door when the door is in the closed position; and wherein, in response to the rotation of the basket, and thus the ice-filled bag disposed therein, about the first axis: the width of the ice-filled bag is generally parallel to the door when the door is in the closed position; and the length of the ice-filled bag is generally parallel to the door when the door is in the closed position. In an exemplary embodiment, each of the disposal zones defines a stacking level; and wherein the system further includes means for selecting the one of the disposal zones, including means for determining the stacking level of each of the disposal zones in the plurality of disposal zones; and means for determining the lowest stacking level of the respective stacking levels of the disposal zones in the plurality of disposal zones, wherein the lowest stacking level is generally equal to the stacking level of the one of the disposal zones.

A system has been described that includes a temperature-controlled storage unit in which a plurality of ice-filled bags are adapted to be stored, the temperature-controlled storage unit defining a region, the region including a plurality of disposal zones, each disposal zone defining a stacking level;

and means for determining the degree to which the region is filled with the ice-filled bags, including measuring the respective stacking level of each of the disposal zones. In an exemplary embodiment, means for measuring the respective stacking level of each of the disposal zones includes means for measuring the respective stacking level of each of the disposal zones using at least one sensor. In an exemplary embodiment, means for measuring the respective stacking level of each of the disposal zones using the at least one sensor includes means for moving the at least one sensor across the disposal zone while the at least one sensor is positioned above the disposal zone; and means for taking a plurality of stacking level measurements using the at least one sensor during moving the at least one sensor across the disposal zone. In an exemplary embodiment, the system includes means for determining whether the region is full of ice-filled bags, including determining whether the degree to which the region is filled with ice-filled bags is equal to or greater than a predetermined percentage. In an exemplary embodiment, the degree to which the region is filled with ice-filled bags is determined using at least a computer, the computer being operably coupled to the temperature-controlled storage unit; and wherein the system further includes means for transmitting data from the computer to a remote user device via a network, the data corresponding to the degree to which the region is filled with ice-filled bags, wherein the remote user device is positioned at a location that is remote from the temperature-controlled storage unit. In an exemplary embodiment, the system includes means for transmitting from the remote user device to the computer via the network a request to determine the degree to which the region is filled with ice-filled bags; wherein the degree to which the region is filled with ice-filled bags is determined in response to the transmitted request.

A computer readable medium has been described that includes a plurality of instructions stored therein, the plurality of instructions including instructions for selecting a disposal zone from a plurality of disposal zones located in a region defined by a temperature-controlled storage unit, each disposal zone defining a stacking level, wherein the stacking level of the selected disposal zone is equal to or lower than the respective stacking levels of the other disposal zones in the plurality of disposal zones; and instructions for disposing an ice-filled bag in the selected disposal zone. In an exemplary embodiment, instructions for selecting the disposal zone from the plurality of disposal zones include instructions for determining the stacking level of each of the disposal zones in the plurality of disposal zones; and instructions for determining the lowest stacking level of the respective stacking levels of the disposal zones in the plurality of disposal zones, wherein the lowest stacking level is generally equal to the stacking level of the selected disposal zone. In an exemplary embodiment, instructions for determining the stacking level of each of the disposal zones in the plurality of disposal zones include instructions for measuring the respective stacking level of each of the disposal zones using at least one sensor. In an exemplary embodiment, instructions for measuring the respective stacking level of each of the disposal zones using the at least one sensor include instructions for moving the at least one sensor across the disposal zone while the at least one sensor is positioned above the disposal zone; and instructions for taking a plurality of stacking level measurements using the at least one sensor during moving the at least one sensor across the disposal zone. In an exemplary embodiment, the plurality of instructions includes instructions for before disposing the ice-filled bag in the selected disposal zone, filling a bag with a measured amount of ice to thereby produce the ice-filled bag, including instructions for at least partially disposing the bag in a basket; and instructions for filling the bag with the measured amount of ice while the bag is at least partially disposed in the basket; wherein instructions for disposing the ice-filled bag in the selected disposal zone include instructions for moving the basket, and thus the ice-filled bag, along a first axis to a position that is generally aligned with the selected disposal zone along the first axis; and instructions for rotating the basket about a second axis to thereby discharge the ice-filled bag from the basket and dispose the ice-filled bag in the selected disposal zone, the second axis being coaxial with, or generally parallel to, the first axis. In an exemplary embodiment, the temperature-controlled storage unit includes at least one door movable between an open position in which access to the region is permitted, and a closed position; wherein the ice-filled bag has a length and a width; and wherein, in response to rotation of the basket about the first axis and the resulting disposal of the ice-filled bag in the selected disposal zone, the ice-filled bag is positioned so that the length of the ice-filled bag is generally perpendicular to the door when the door is in the closed position. In an exemplary embodiment, the plurality of instructions includes instructions for rotating the basket, and thus the ice-filled bag, about a third axis that is generally perpendicular to each of the first and second axes, wherein the basket is rotated about the third axis after the bag is filled with ice but before the basket is rotated about the second axis. In an exemplary embodiment, the plurality of instructions includes instructions for determining whether the region is full of ice-filled bags; and instructions for if the region is not full of ice-filled bags, then selecting another disposal zone from the plurality of disposal zones, wherein the stacking level of the another selected disposal zone is equal to or lower than the respective stacking levels of the other disposal zones in the plurality of disposal zones; and disposing another ice-filled bag in the another selected disposal zone. In an exemplary embodiment, instructions for determining whether the region is full of ice-filled bags include instructions for determining the degree to which the region is filled with ice-filled bags; and instructions for determining whether the degree to which the region is filled with ice-filled bags is equal to or greater than a predetermined percentage. In an exemplary embodiment, the plurality of instructions includes instructions for determining the degree to which the region is filled with ice-filled bags. In an exemplary embodiment, the degree to which the region is filled with ice-filled bags is determined using at least a computer, the computer being operably coupled to the temperature-controlled storage unit; and wherein the plurality of instructions further includes instructions for transmitting data from the computer to a remote user device via a network, the data corresponding to the degree to which the region is filled with ice-filled bags, wherein the remote user device is positioned at a location that is remote from the temperature-controlled storage unit. In an exemplary embodiment, the plurality of instructions further includes instructions for transmitting from the remote user device to the computer via the network a request to determine the degree to which the region is filled with ice-filled bags; wherein the degree to which the region is filled with ice-filled bags is determined in response to the transmitted request. In an exemplary embodiment, instructions for determining the degree to which the region is filled with ice-filled bags include instructions for measuring the respective stacking level of each of the disposal zones, including instructions for moving at least one sensor across the disposal zone while the at least one sensor is positioned above the disposal zone; and instructions for taking a plurality of stacking level measurements using the at least one sensor during moving the at least one sensor across the disposal zone. In an exemplary embodiment, the storage unit includes front and back inside walls spaced in a parallel relation; wherein the ice-filled bag has a length and a width; and wherein, in response to disposing the ice-filled bag in the selected disposal zone, the ice-filled bag is positioned in the selected disposal zone so that: the length is generally perpendicular to each of the front and back inside walls; and the width is generally parallel to each of the front and back inside walls.

A computer readable medium has been described that includes a plurality of instructions stored therein, the plurality of instructions including instructions for disposing an ice-filled bag in one disposal zone, the one disposal zone being part of a plurality of disposal zones located in a region defined by a temperature-controlled storage unit, the instructions for disposing the ice-filled bag in the one disposal zone including instructions for rotating about a first axis a basket in which the ice-filled bag is disposed; instructions for moving the basket, and thus the ice-filled bag disposed therein, along a second axis to a position that is generally aligned with the one disposal zone along the second axis, the second axis being generally perpendicular to the first axis; and instructions for rotating the basket about a third axis, the third axis being generally perpendicular to the first axis and coaxial with, or generally parallel to, the second axis; wherein, in response to the rotation of the basket about the third axis, the ice-filled bag is discharged from the basket and disposed in the one of the disposal zones. In an exemplary embodiment, the temperature-controlled storage unit includes at least one door movable between an open position in which access to the region is permitted, and a closed position; wherein the ice-filled bag has a length and a width; and wherein, in response to the rotation of the basket about the third axis and the resulting disposal of the ice-filled bag in the one of the disposal zones, the ice-filled bag is positioned so that: the width of the ice-filled bag is generally parallel to the door when the door is in the closed position, and the length of the ice-filled bag is generally perpendicular to the door when the door is in the closed position. In an exemplary embodiment, when the ice-filled bag is initially disposed in the basket: the width of the ice-filled bag is generally perpendicular to the door when the door is in the closed position, and the length of the ice-filled bag is generally parallel to the door when the door is in the closed position; and wherein, in response to the rotation of the basket, and thus the ice-filled bag disposed therein, about the first axis: the width of the ice-filled bag is generally parallel to the door when the door is in the closed position; and the length of the ice-filled bag is generally parallel to the door when the door is in the closed position. In an exemplary embodiment, each of the disposal zones defines a stacking level; and wherein the plurality of instructions further includes instructions for selecting the one of the disposal zones, including instructions for determining the stacking level of each of the disposal zones in the plurality of disposal zones; and instructions for determining the lowest stacking level of the respective stacking levels of the disposal zones in the plurality of disposal zones, wherein the lowest stacking level is generally equal to the stacking level of the one of the disposal zones.

A computer readable medium has been described that includes a plurality of instructions stored therein, the plurality of instructions including instructions for determining the degree to which a region is filled with a plurality of ice-filled bags, the region being defined by a temperature-controlled storage unit in which the plurality of ice-filled bags are adapted to be stored, the disposal zones defining respective stacking levels, the instructions for determining the degree to which the region is filled including instructions for measuring the respective stacking level of each of the disposal zones. In an exemplary embodiment, instructions for measuring the respective stacking level of each of the disposal zones include instructions for measuring the respective stacking level of each of the disposal zones using at least one sensor. In an exemplary embodiment, instructions for measuring the respective stacking level of each of the disposal zones using the at least one sensor include instructions for moving the at least one sensor across the disposal zone while the at least one sensor is positioned above the disposal zone; and instructions for taking a plurality of stacking level measurements using the at least one sensor during moving the at least one sensor across the disposal zone. In an exemplary embodiment, the plurality of instructions includes instructions for determining whether the region is full of ice-filled bags, including instructions for determining whether the degree to which the region is filled with ice-filled bags is equal to or greater than a predetermined percentage. In an exemplary embodiment, the degree to which the region is filled with ice-filled bags is determined using at least a computer, the computer being operably coupled to the temperature-controlled storage unit; and wherein the plurality of instructions further includes instructions for transmitting data from the computer to a remote user device via a network, the data corresponding to the degree to which the region is filled with ice-filled bags, wherein the remote user device is positioned at a location that is remote from the temperature-controlled storage unit. In an exemplary embodiment, the plurality of instructions includes instructions for transmitting from the remote user device to the computer via the network a request to determine the degree to which the region is filled with ice-filled bags; wherein the degree to which the region is filled with ice-filled bags is determined in response to the transmitted request.

An apparatus has been described that includes a temperature-controlled storage unit, the temperature-controlled storage unit defining a region in which a plurality of ice-filled bags are adapted to be stored; and a basket in which each of the ice-filled bags is adapted to be disposed before being stored in the region; wherein the basket is movably coupled to the storage unit so that at least a portion of the basket is permitted to move within the region along a first axis; wherein the basket is rotatable, about a second axis, between a first rotational position and a second rotational position, the second axis being generally perpendicular to the first axis; and wherein the basket is rotatable about a third axis, the third axis being: generally perpendicular to the first axis when the basket is in the first rotational position; and coaxial with, or generally parallel to, the first axis when the basket is in the second rotational position. In an exemplary embodiment, the apparatus includes a first motor coupled to the basket and configured to rotate the basket about the second axis; and a second motor coupled to the basket and configured to rotate the basket about the third axis. In an exemplary embodiment, the apparatus includes a ring bearing, the ring bearing comprising a first ring and a second ring coupled thereto and circumferentially extending thereabout, wherein the ring bearing is configured to permit relative rotation between the first and second rings and about the second axis; wherein the first and second motors are coupled to one of the first and second rings; and wherein the basket, the first and second motors, and the one of the first and second rings are rotatable, about the second axis and relative to the other of the first and second rings. In an exemplary embodiment, the apparatus includes a first sensor coupled to the one of the first and second rings so that the first sensor is positioned at a first location; and a second sensor coupled to the one of the first and second rings so that the second sensor is positioned at a second location that is generally diametrically opposite the first location; wherein the basket, the first and second motors, the first and second sensors, and the one of the first and second rings are rotatable, about the second axis and relative to the other of the first and second rings. In an exemplary embodiment, the apparatus includes the plurality of ice-filled bags, each of the ice-filled bags having a length and a width; wherein the region comprises a plurality of disposal zones in which the ice-filled bags are stacked, each disposal zone defining a stacking level; wherein the temperature-controlled storage unit comprises at least one door movable between an open position in which access to the region is permitted, and a closed position; wherein each of the ice-filled bags is stacked in one of the disposal zones in response to the rotation of the basket about the third axis when the basket is in the second rotational position, the ice-filled bag being stacked so that the length of the ice-filled bag is generally perpendicular to the door when the door is in the closed position. In an exemplary embodiment, the region comprises a plurality of disposal zones in which the ice-filled bags are adapted to be stacked, each disposal zone defining a stacking level; and wherein the apparatus further comprises a processor; and a computer readable medium operably coupled to the processor, the computer readable medium comprising a plurality of instructions stored therein and executable by at least the processor, the plurality of instructions comprising instructions for determining the stacking level of each of the disposal zones in the plurality of disposal zones; and instructions for determining the lowest stacking level of the respective stacking levels of the disposal zones in the plurality of disposal zones. In an exemplary embodiment, the apparatus comprises a carriage to which the other of the first and second rings is coupled; wherein the basket, the first and second motors, the first and second sensors, and the one of the first and second rings are rotatable, about the second axis and relative to the carriage and the other of the first and second rings; and wherein the carriage is movably coupled to the storage unit to thereby movably couple the basket to the storage unit.

A method has been described that includes providing a basket and an ice-filled bag initially disposed therein, the ice-filled bag having a length and a width; providing a temperature-controlled storage unit, the storage unit comprising front and back inside walls spaced in a parallel relation, the storage unit defining a region, the region comprising a plurality of disposal zones; and actuating the basket to dispose the ice-filled bag in one of the disposal zones so that: the length is generally perpendicular to each of the front and back inside walls; and the width is generally parallel to each of the front and back inside walls. In an exemplary embodiment, actuating the basket to dispose the ice-filled bag in the one of the disposal zones comprises rotating the basket, and thus the ice-filled bag disposed therein, about a first axis; moving the basket, and thus the ice-filled bag disposed therein, along a second axis to a position that is generally aligned with the one disposal zone along the second axis, the second axis being generally perpendicular to the first axis; and rotating the basket about a third axis, the third axis being generally perpendicular to the first axis and coaxial with, or generally parallel to, the second axis; wherein, in response to the rotation of the basket about the third axis, the ice-filled bag is discharged from the basket and disposed in the one of the disposal zones.

A system has been described that includes a basket and an ice-filled bag initially disposed therein, the ice-filled bag having a length and a width; a temperature-controlled storage unit, the storage unit comprising front and back inside walls spaced in a parallel relation, the storage unit defining a region, the region comprising a plurality of disposal zones; and means for actuating the basket to dispose the ice-filled bag in one of the disposal zones so that: the length is generally perpendicular to each of the front and back inside walls; and the width is generally parallel to each of the front and back inside walls. In an exemplary embodiment, means for actuating the basket to dispose the ice-filled bag in the one of the disposal zones comprises means for rotating the basket, and thus the ice-filled bag disposed therein, about a first axis; means for moving the basket, and thus the ice-filled bag disposed therein, along a second axis to a position that is generally aligned with the one disposal zone along the second axis, the second axis being generally perpendicular to the first axis; and means for rotating the basket about a third axis, the third axis being generally perpendicular to the first axis and coaxial with, or generally parallel to, the second axis; wherein, in response to the rotation of the basket about the third axis, the ice-filled bag is discharged from the basket and disposed in the one of the disposal zones.

It is understood that variations may be made in the foregoing without departing from the scope of the disclosure. Furthermore, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references such as, for example, "upper," "lower," "above," "below," "between," "vertical," "horizontal," "angular," "upwards," "downwards," "side-to-side," "left-to-right," "right-to-left," "top-to-bottom," "bottom-to-top," "top," "bottom," "bottom-up," "top-down," "front-to-back," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. An apparatus, comprising:

a temperature-controlled storage unit, the temperature-controlled storage unit defining a region in which a plurality of ice-filled bags are adapted to be stored, each of the ice-filled bags having a length, a width, a top portion via which the ice-filled bag is filled with ice, and a bottom portion opposing the top portion along the length;

wherein the storage unit comprises:

front and back inside walls spaced in a parallel relation;

an opening formed in the front inside wall; and at least one door connected to the front inside wall, the door being movable between an open position in which access to the region via the opening is permitted, and a closed position;

and wherein the region comprises:

a front row comprising a plurality of disposal zones, each disposal zone of the front row being adjacent to the front inside wall; and a back row comprising a plurality of disposal zones, each disposal zone of the back row being adjacent to the back inside wall;

a basket in which each of the ice-filled bags is adapted to be disposed before being stored in the region;

wherein the basket is rotatable, about a first axis, between a first rotational position and a second rotational position;

wherein the basket is movably coupled to the storage unit so that at least a portion of the basket is permitted to move within the region along a second axis, the second axis being generally perpendicular to the first axis;

wherein the basket is rotatable about a third axis in a first rotational direction and a second rotational direction, the first rotational direction being opposite the second rotational direction;

wherein the third axis is generally perpendicular to the second axis when the basket is in the first rotational position;

wherein the third axis is coaxial with, or generally parallel to, the second axis when the basket is in the second rotational position;

wherein the third axis is generally perpendicular to the first axis when the basket is in the first rotational position and the second rotational position;

wherein the first axis extends through the basket;

wherein the second axis extends through the basket;

wherein the third axis extends through the basket;

wherein the first axis intersects with the second axis at a location within the basket; and wherein the first axis intersects with the third axis at the location within the basket;

a first motor coupled to the basket and configured to rotate the basket about the first axis;

a second motor coupled to the basket and configured to rotate the basket about the third axis;

a ring bearing, the ring bearing comprising a first ring and a second ring coupled thereto and circumferentially extending thereabout, wherein the ring bearing is configured to permit relative rotation between the first and second rings and about the first axis, and wherein the first and second motors are coupled to one of the first and second rings;

a first sensor coupled to the one of the first and second rings so that the first sensor is positioned at a first location;

a second sensor coupled to the one of the first and second rings so that the second sensor is positioned at a second location that is generally diametrically opposite the first location;

a carriage to which the other of the first and second rings is coupled;

and an opening formed through the carriage and through which ice passes to fill each of the ice-filled bags;

wherein the first axis extends through the opening; and wherein at least a portion of the opening is positioned above at least a portion of the basket;

wherein the basket, the first and second motors, the first and second sensors, and the one of the first and second rings are rotatable, about the first axis and relative to the carriage, the opening, and the other of the first and second rings;

wherein the carriage is movably coupled to the storage unit to thereby movably couple the basket to the storage unit;

wherein, when a first ice-filled bag in the plurality of bags is initially disposed in the basket, the width of the first ice-filled bag is generally perpendicular to the door when the door is in the closed position, and the length of the first ice-filled bag is generally parallel to the door when the door is in the closed position;

wherein the first ice-filled bag in the plurality of ice-filled bags is stackable in the region in response to the rotation of the basket about the third axis in the first rotational direction when the basket is in the second rotational position at a first position along the second axis, the first ice-filled bag being stackable so that the length of the first ice-filled bag is generally perpendicular to the door when the door is in the closed position;

wherein, when a second ice-filled bag in the plurality of bags is initially disposed in the basket, the width of the second ice-filled bag is generally perpendicular to the door when the door is in the closed position, and the length of the second ice-filled bag is generally parallel to the door when the door is in the closed position;

wherein the second ice-filled bag in the plurality of ice-filled bags is stackable in the region in response to the rotation of the basket about the third axis in the second rotational direction when the basket is in the second rotational position at the first position along the second axis, the second ice-filled bag being stackable so that the length of the ice-filled bag is generally perpendicular to the door when the door is in the closed position; and wherein, when the first and the second ice-filled bags are stacked in the region:

the first ice-filled bag is stacked in a first disposal zone located in one of the front and back rows;

the second ice-filled bag is stacked in a second disposal zone located in the other of the front and back rows;

the top portion of the first ice-filled bag and the top portion of the second ice-filled bag are each positioned about midway between the front and the back inside walls;

the bottom portion of the first ice-filled bag is adjacent to one of the front and back inside walls; and the bottom portion of the second ice-filled bag is adjacent to the other of the front and back inside walls.

2. The apparatus of claim 1, wherein each of the disposal zones defines a stacking level; and wherein the apparatus further comprises:

a processor; and a computer readable medium operably coupled to the processor, the computer readable medium comprising a plurality of instructions stored therein and executable by at least the processor, the plurality of instructions comprising:

instructions for determining the stacking level of each of the disposal zones; and instructions for determining the lowest stacking level of the respective stacking levels of the disposal zones.

* * * * *